US007905285B2

(12) United States Patent
Cuthill

(10) Patent No.: US 7,905,285 B2
(45) Date of Patent: Mar. 15, 2011

(54) METHOD AND APPARATUS FOR PERFORATING A CASING AND PRODUCING HYDROCARBONS

(75) Inventor: David A. Cuthill, DeWinton (CA)

(73) Assignee: Precision Energy Services, Inc., Houston, TX (US)

( * ) Notice: Subject to any disclaimer, the term of this patent is extended or adjusted under 35 U.S.C. 154(b) by 0 days.

(21) Appl. No.: 12/503,724

(22) Filed: Jul. 15, 2009

(65) Prior Publication Data

US 2009/0272527 A1 Nov. 5, 2009

Related U.S. Application Data

(63) Continuation of application No. 11/740,171, filed on Apr. 25, 2007, now Pat. No. 7,571,768.

(30) Foreign Application Priority Data

Apr. 25, 2006 (CA) ..... 2544818

(51) Int. Cl.
*E21B 43/116* (2006.01)
*E21B 37/00* (2006.01)

(52) U.S. Cl. ..... 166/297; 166/311

(58) Field of Classification Search ..... 166/297, 166/55.1, 311; 175/4.54
See application file for complete search history.

(56) References Cited

U.S. PATENT DOCUMENTS

| | | | | |
|---|---|---|---|---|
| 4,614,156 | A | 9/1986 | Colle, Jr. et al. | |
| 6,148,730 | A | 11/2000 | Watson | |
| 6,173,783 | B1 | 1/2001 | Abbott-Brown et al. | |
| 6,554,081 | B1 | 4/2003 | Brookes et al. | |
| 6,598,682 | B2 | 7/2003 | Johnson et al. | |
| 6,732,798 | B2 | 5/2004 | Johnson et al. | |
| 6,874,579 | B2 | 4/2005 | Johnson et al. | |
| 7,284,612 | B2 | 10/2007 | Ratanasirigulchai et al. | |
| 7,571,768 | B2 * | 8/2009 | Cuthill | 166/297 |
| 2002/0020535 | A1 * | 2/2002 | Johnson et al. | 166/363 |
| 2003/0089498 | A1 | 5/2003 | Johnson et al. | |
| 2004/0089449 | A1 | 5/2004 | Walton et al. | |
| 2004/0099418 | A1 | 5/2004 | Behrmann et al. | |
| 2004/0159434 | A1 | 8/2004 | Johnson et al. | |
| 2004/0231840 | A1 | 11/2004 | Ratanasirigulchai et al. | |
| 2005/0247449 | A1 | 11/2005 | George et al. | |
| 2007/0034369 | A1 | 2/2007 | Ratanasirigulchai et al. | |
| 2009/0084552 | A1 * | 4/2009 | Behrmann et al. | 166/298 |

OTHER PUBLICATIONS

J.G. Flores, Perforating for Zero Skin: A Study of Productivity Improvement in Ecuador, SPE 95859, Oct. 9, 2005, pp. 1-7, Society of Petroleum Engineers, US.

(Continued)

*Primary Examiner* — Hoang Dang
(74) *Attorney, Agent, or Firm* — Mark A. Oathout

(57) ABSTRACT

A perforating gun and one or more volume-receiving surge canisters can be actuated at a time delay after perforation for creating a dynamic underbalance condition to aid in directing debris out of the perforations and fractures and into the wellbore. A timer and triggering device actuate one or more canisters in parallel or series after a pre-determined time delay or delays which can be related to wellbore conditions following perforation. Use of propellant-type perforating gun further benefits from favorable propellant burn conditions for forming perforations and followed thereafter by a perforation-cleaning underbalance pressure conditions characterized by one or more of an increased rate of change depression of the pressure in the adjacent annulus, a greater magnitude of pressure depression and a longer duration of underbalance.

18 Claims, 23 Drawing Sheets

OTHER PUBLICATIONS

Eelco Bakker, Kees Veeken, Larry Behrmann, Phil Milton, Gary Stirton, Alan Salsman, Ian Walton, Lloyd Stutz, and David Underdown, The New Dynamics of Underbalanced Perforating, Oilfield Review, Winter 2003/2004, pp. 54-67.

John F. Schatz Research & Consulting, Inc., Perf Breakdown, Fracturing, and Cleanup in PulsFrac, Feb. 10, 2007, pp. 1-6, John F. Schatz Research & Consulting, Inc., US.

Schlumberger, Pure, Jul. 2003, pp. 1-2, Schlumberger, www.slb.com/oilfield.

Behrmann, Li, Venkitaraman, Li, Borehole Dynamics During Underbalanced Perforating,Society of Petroleum Engineers, SPE 38139,Jun. 2, 1997, pp. 17-24, The Hague, Netherlands.

Behrmann, Hughes, Johnson, Walton, New Underbalanced Perforating Technique Increases Completion Efficiency and Eliminates Costly Acid Stimulation, Society of Petroleum Engineers, SPE 77364, Sep. 29, 2002, pp. 1-15, San Antonio, US.

Stenhaug, Erichsen, Doornbosch, Parrott, A Step Change in Perforating Technology Improves Productivity of Horizontal Wells in the North Sea, Society of Petroleum Engineers, SPE 84910, Oct. 20, 2003, pp. 1-11, Kuala Lumpur, Malaysia.

Subiaur, Graham, Walton, Atwood, Underbalance Pressure Criteria for Perforating Carbonates, Society of Petroleum Engineers, SPE 86542, Feb. 18, 2004, pp. 1-12, Lafayette US.

* cited by examiner

METHOD AND APPARATUS FOR PERFORATING A CASING AND PRODUCING HYDROCARBONS

CROSS REFERENCE TO RELATED APPLICATIONS

This application is a continuation of U.S. patent application Ser. No. 11/740,171, filed Apr. 25, 2007 now U.S. Pat. No. 7,571,768, which claims priority of Canadian Patent Application No. 2,544,818, filed Apr. 25, 2006.

FEDERALLY SPONSORED RESEARCH OR DEVELOPMENT

Not applicable.

REFERENCE TO LISTING, TABLES OR COMPACT DISK APPENDIX

Not applicable.

FIELD OF THE INVENTION

Embodiments of the invention relate to perforating a wellbore to produce hydrocarbons from a formation into the wellbore. More particularly, embodiments of the invention relate to perforating the wellbore during balanced or overbalanced conditions followed by creation of a dynamic underbalanced condition and more particularly using propellant-based perforating guns.

BACKGROUND OF THE INVENTION

A hydrocarbon-producing formation can be accessed by drilling a wellbore to the formation and opening fluid communication between the formation and the bore of the wellbore for the recovery of hydrocarbons therefrom. Typically, a string of casing is installed along the wellbore and it is known in the industry to perforate the casing using a perforating gun for piercing the casing and affecting the formation to establish fluid communication between the formation and the bore of the cased wellbore for production of the hydrocarbons therefrom.

For a variety of pressure-management issues including safety objectives, perforating has traditionally been conducted in balanced or overbalanced conditions where the fluid pressure in the wellbore at the time of perforating the casing has been equal, greater, or far greater, than the pressure in the formation. Under competing objectives, management of the interface of the formation has resulted in attempts to conduct perforation under both static and dynamic underbalanced conditions wherein the pressure in the wellbore is less than that in the formation. It is thought that the underbalanced conditions during perforating result in a surge or flow which causes the perforations and formation to be cleaned of debris and the like as the fluid flow from the formation surges toward the lower pressure wellbore. In some cases underbalanced perforation has been performed by detonating conventional shaped charges to pierce the casing and, at substantially the same time, canisters are opened in the wellbore for creating a void. Creation of the void and the resulting inrush of fluid results in an enhanced and temporary underbalanced condition which causes fluid to surge from the formation to the wellbore, thereby effecting some degree of cleaning of the perforation and the formation.

Alternatively, as taught in U.S. Pat. No. 6,732,798 to Johnson et al., a porous material is pulverized to expose additional volume to receive wellbore fluids and create the void when activated by an explosive device. U.S. Pat. No. 6,173,783 to Abbott-Brown et al. teaches perforating at extreme overbalanced conditions followed by an underbalanced surge to clean the fractures in the formation. The overbalanced condition is created by forming a fluid column in a tubing string which extends down the casing string to the formation, positioning ports in the tubing string downhole from a packer set in the annulus between the tubing string and the casing. Sufficient gas is added to the fluid column so as to achieve a pressure which exceeds the fracture gradient of the formation. Following perforating the casing, the pressure is maintained below the packer and sufficient volumes of gas are removed from the well so that it is in an underbalanced state after which the ports in the tubing are opened to release the pressure below the packer and cause the flow of fluids to surge from the formation into the tubing string. Typically nitrogen or carbon dioxide are used to charge the tubing string.

U.S. published patent application 2005/0247449 to George et al., teaches using shaped charges in a perforating gun to perforate the casing, preferably at overbalanced conditions. Substantially simultaneously, a combustible element such as a propellant or the like is ignited in a combustion chamber in the perforating gun assembly and the products of the combustion of the combustible element cause a sleeve in a surge canister to shift, opening holes in the canister to the wellbore for creating a dynamic underbalanced condition therein.

There is interest in the industry for improved methods of perforation and production of hydrocarbons which take advantage of the safety and other benefits of balanced and overbalanced perforation as well as the advantages of creating even more pronounced underbalanced conditions.

SUMMARY OF THE INVENTION

Embodiments of the invention create a dynamic underbalance at a point in time delayed following perforation of a zone of interest for effectively clearing the perforations for enhanced fluid production therefrom. The perforation results in an initial elevated pressure event, sometime after which a surge canister is opened to cause a temporary underbalance pressure condition characterized by one or more of an increased rate of change depression of the pressure in the adjacent annulus, a greater magnitude of pressure depression and a longer duration of underbalance.

In one embodiment of the invention, a perforating gun, a timing mechanism, void creating technology such as volume-receiving surge canisters, and a trigger device for actuating the surge canisters at some time delay after perforation are employed to create a surge in the formation to direct debris out of the perforations and fractures and into the wellbore.

In another embodiment, perforating guns including using a propellant can be employed. Despite a trend away from the use of initial, yet undesirable overbalanced formation conditions, the perforation with propellant is generally conducted in an overbalanced, balanced or less than desirable underbalanced conditions for encouraging maximal burn of the propellant and once the profile of the pressure surge from the propellant reaches a time delay, or at a time delay corresponding to a threshold pressure, actuating one or more of the surge canisters for creating a pronounced underbalanced condition. The perforation and void events can be timed to maximize beneficial effects of the perforating with propellant. The pressure profile can be maintained at a higher pressure until an effective amount of propellant has been consumed and then the surge canisters is actuated to shift the pressure profile to underbalanced conditions. Herein, propellant-type perforation guns are also referred to a stimulation guns to distinguish as appropriate from non-propellant perforating guns.

In a broad aspect, a method for creating a period of dynamic underbalance at a zone of interest in a wellbore is provided comprising: positioning a perforation assembly in the wellbore at the zone of interest for creating an annulus between the assembly and the wellbore, the annulus containing fluid and having an initial hydrostatic pressure, the assembly having at least a perforation gun and one or more surge canisters; actuating the perforating gun for creating an initial pressure event and forming perforations at the zone of interest and wherein dynamic pressure in the annulus reaches a first initial elevated pressure; delaying until the dynamic pressure diminishes from the first initial elevated pressure; and then opening at least one of the one or more surge canisters so as to receive a surge of the fluid therein for creating the period of dynamic underbalance. Two or more surge canisters can be actuated in parallel or in series.

In another aspect, apparatus for conducting various method embodiments of the invention includes a downhole assembly for creating a period of dynamic underbalance at a zone of interest in a wellbore comprising: a perforating gun; and at least one surge canister supported in the wellbore with the perforating gun at the zone of interest and creating an annulus between the assembly and the wellbore; a trigger device coupled to the at least one surge canister and actuable for opening the surge canister to fluid in the annulus; a timer for actuating the trigger device after a time delay wherein after actuating the perforating gun for creating an initial pressure event and forming perforations at the zone of interest, the timer delays actuating the trigger device until the expiry of the time delay for opening the at least one surge canister so as to receive a surge of the fluid therein for creating the period of dynamic underbalance.

BRIEF DESCRIPTION OF THE DRAWINGS

FIG. 7A illustrates the trigger device of FIG. 5 prior to perforation;

FIG. 7B illustrates the timing piston having actuated over a time delay to engage and break the trigger bar;

FIG. 7C illustrates pressure actuation of the valve sleeve to open the surge ports;

DETAILED DESCRIPTION OF EMBODIMENTS OF THE INVENTION

Embodiments of the invention utilize methods for producing periods of dynamic underbalance at perforations formed in a zone of interest in a formation accessed by a wellbore. The dynamic underbalance is introduced at one or more time delays after perforation of a zone of interest for enhancing the positive effects of the underbalance on the zone of interest. More particularly, so as to clean the perforation tunnels or the formation generally, it is preferable to achieve an underbalanced condition sometime after perforating. Unlike the majority of conventional underbalanced techniques which rely on establishing an underbalanced condition prior to perforation or simultaneous upon perforation, embodiments of the invention actively introduce a dynamic underbalance condition or conditions after perforation to accentuate beneficial effects.

In some embodiments, the dynamic underbalance is triggered after a pre-determined time delay after perforation. In other embodiments, the dynamic underbalance is triggered upon reaching a specified condition in the wellbore, which happens to occur after perforation, including reaching a predetermined particular pressure or liquid density in the wellbore adjacent the perforations at some time delay after perforation. Examples of pre-determined time delay after perforation including timing corresponding to pre-determined pressures including a dynamic pressure relative to the initial hydrostatic pressure before perforation, a pressure inflection, or a state of the perforation event itself. The specified condition can be a theoretical condition which is predetermined and which can correspond to a pre-determined time delay. In other embodiments the specified condition can be measured in-situ. An example of the specified condition that can be measured in site includes establishing an initial static density of the fluid in the annulus prior to actuation of the perforating gun and, after actuating of the perforating gun, measuring a dynamic density of the fluid, and delaying until the measured dynamic density is about the initial density.

Figure 1:
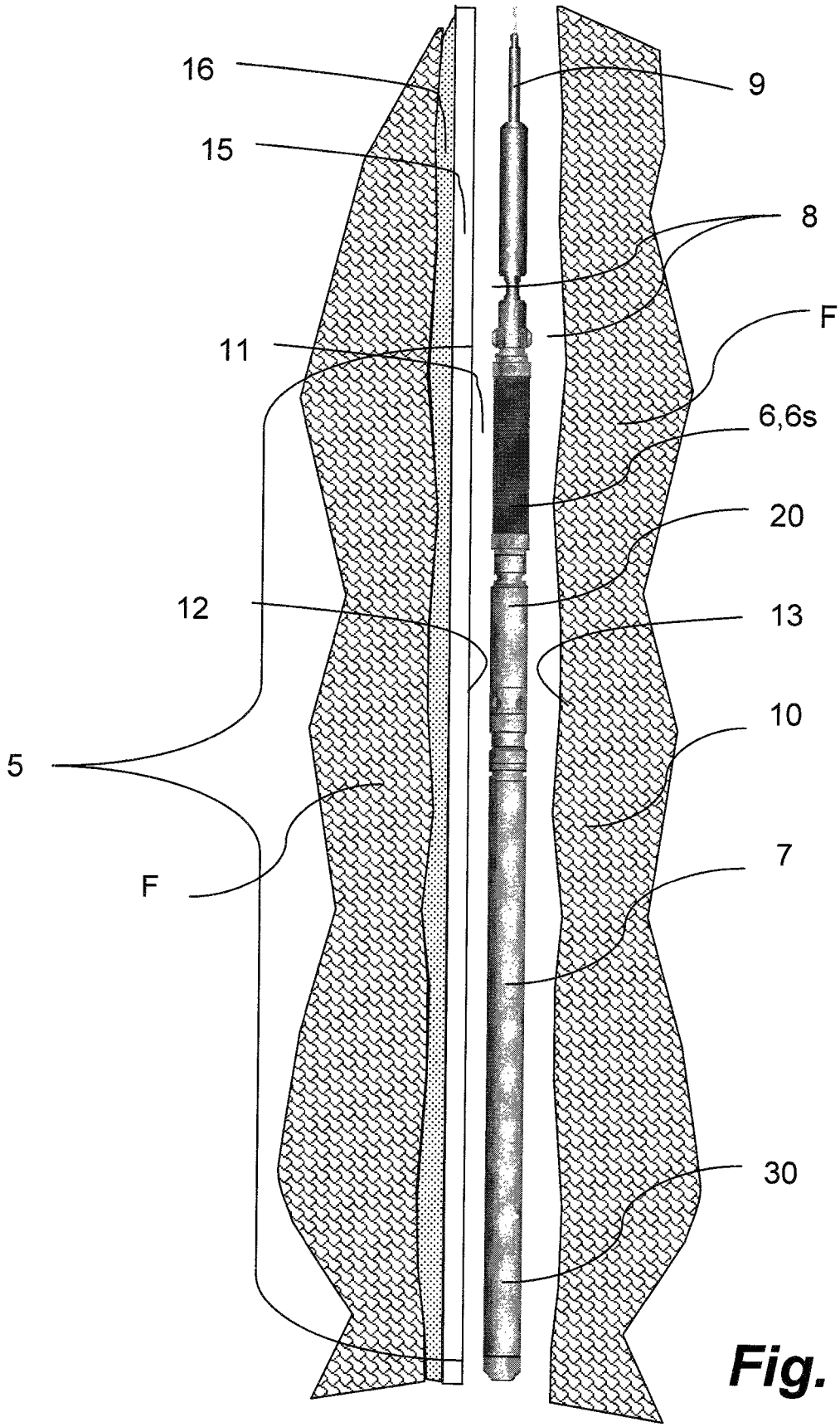
FIG. 1 is a side view of an embodiment of the present invention, illustrating a downhole assembly of a perforation gun, a surge canister, and a trigger device for opening the surge canister. The assembly is shown in an unperforated, cased wellbore (left cross-section of formation) and in an open hole (right cross-section of formation)

In general, embodiments of the invention utilize the sudden creation of a void in the wellbore after a time delay following perforation, for the depression of the wellbore pressure adjacent the now-perforated zone of interest in the formation. A dynamic underbalance occurs as a result of an influx or surge of fluids from the wellbore and into the void volume. For example, one of which is illustrated in FIG. 1, apparatus capable of forming such a void can be actuated following a time delay after perforation including the actuated opening of a chamber which is at a pressure lower than the hydrostatic pressure at the zone of interest. Embodiments of the invention include surge canisters which are part of a downhole tool including a perforating gun. Each surge canister comprises a vessel which contains an effective volume or chamber at a relatively low pressure compared to the wellbore hydrostatic pressure at the zone of interest, such as atmospheric pressure. A triggering device actuates a valve which can interface between the surge canister and the wellbore for actuating the valve only after the time delay (determined by time or wellbore condition) and establishing fluid communication between the chamber and the wellbore. The surge of fluid into the chamber creates a pressure response in the wellbore, and more particularly at the perforations.

Figure 14:
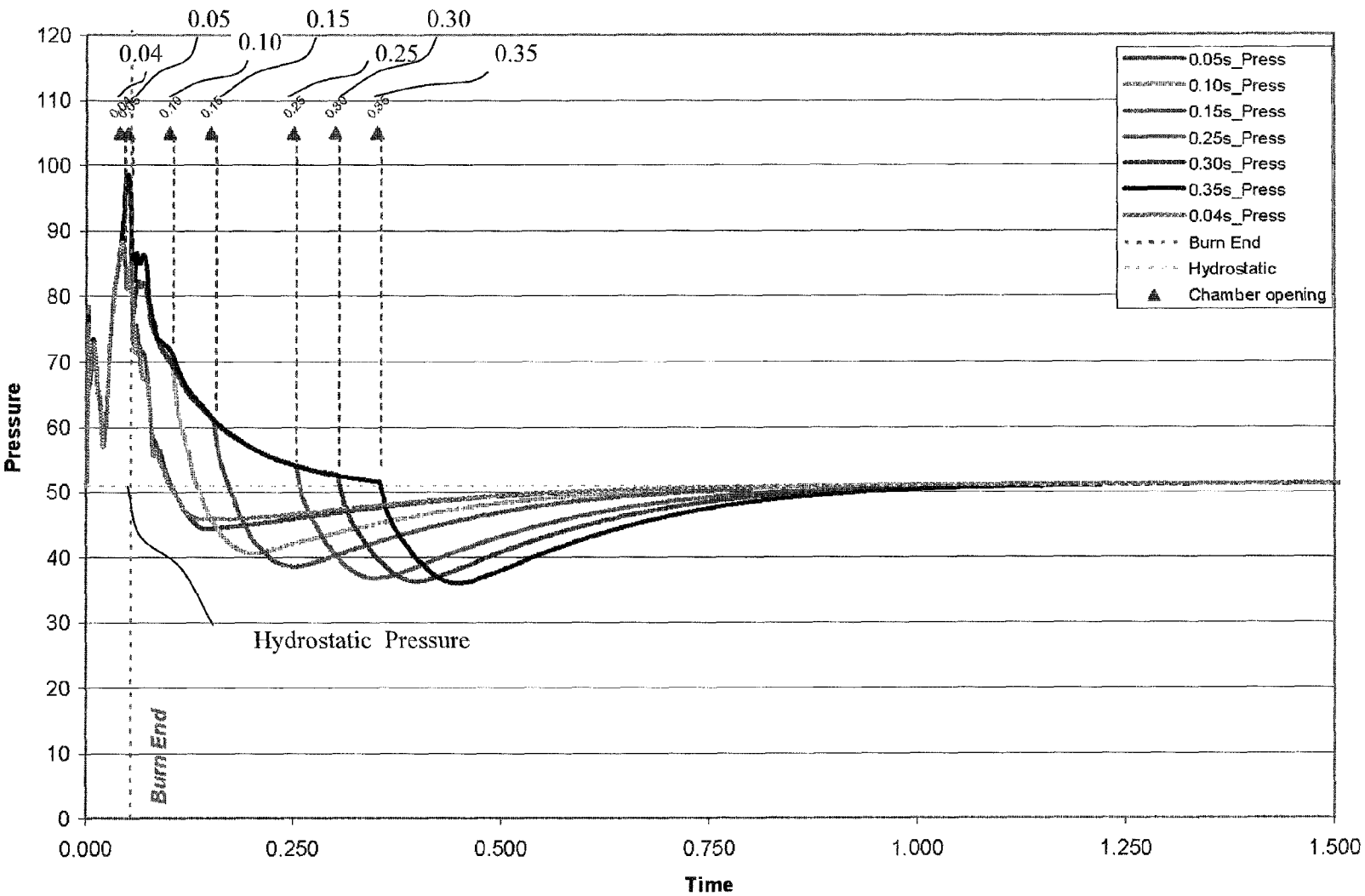
FIG. 14 is a graph illustrating a series of modeled pressure profiles of the detonation of a stimulation gun followed by the opening of a surge canister after a variety of time delays according to Example 5.

With reference to FIG. 14 which is described in greater detail below, a series of pressure responses are illustrated which demonstrate the effect of introducing a dynamic underbalance on a wellbore at various time delays after perforating. While it is conventionally expected that the pressure in the wellbore will diminish from the initial pressure event to return substantially to pre-perforation pressures, the creation of a dynamic underbalance at a time delay sometime after the initial pressure event can result in significant depression in the pressure.

With reference to FIGS. 1 through 8B, embodiments of apparatus capable of implementing the method of the invention are provided.

Figure 3A:
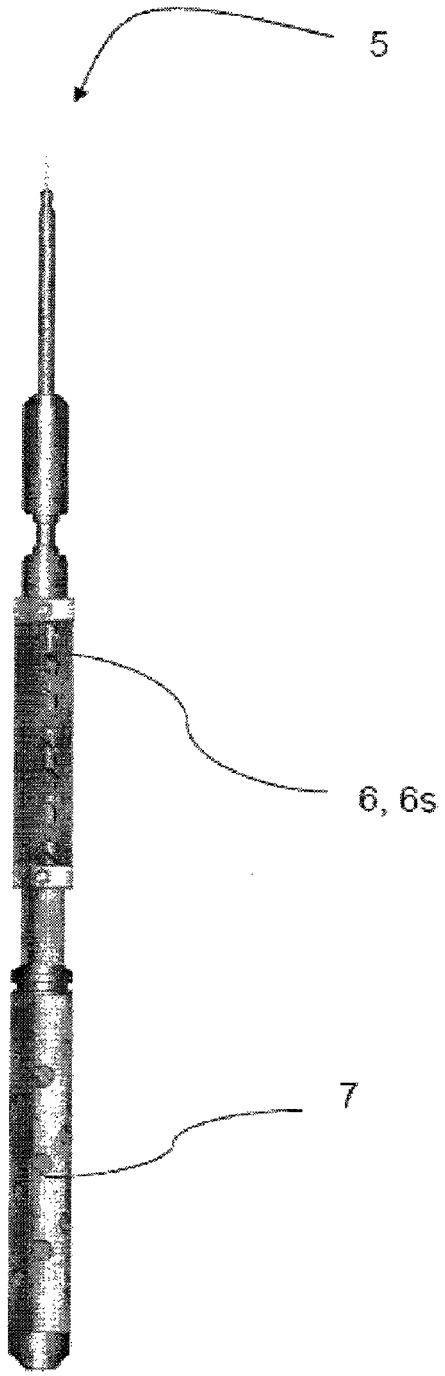
FIG. 3A is a side view of an embodiment of the present invention, illustrating a perforation gun, shown fit with a sleeve-type propellant configured on the outside of the gun, and a single surge canister fit downhole of the gun.

In one embodiment, and with reference to FIGS. 1 and 3A, a downhole assembly 5 comprises a perforating gun 6 and at least one surge canister 7 adjacent thereto. The downhole assembly 5 can be run into a wellbore 8 by wireline 9 or other conveyance and is positioned at a subterranean formation F having a zone of interest 10 therein. As is known to those of skill in the art, the components of the assembly 5 include means for connection and supporting the assembly 5 in the wellbore 8 including a rope socket, casing collar locator and perforating gun actuation assembly. An annulus 11 is formed in the wellbore 8 between the formation F and the downhole assembly 5. The annulus 11 contains fluid which forms an initial hydrostatic pressure P0 which is typically sufficient to place the formation F in an overbalanced or near balanced condition. Herein, the wellbore 8 is referred to in the context of a cased wellbore 12 (left section of the formation of FIG. 1), however, the wellbore 8 could be an open hole 13 (right section of the formation of FIG. 1) with the formation F exposed to the wellbore 8 and which can be perforated directly.

Figure 2A:
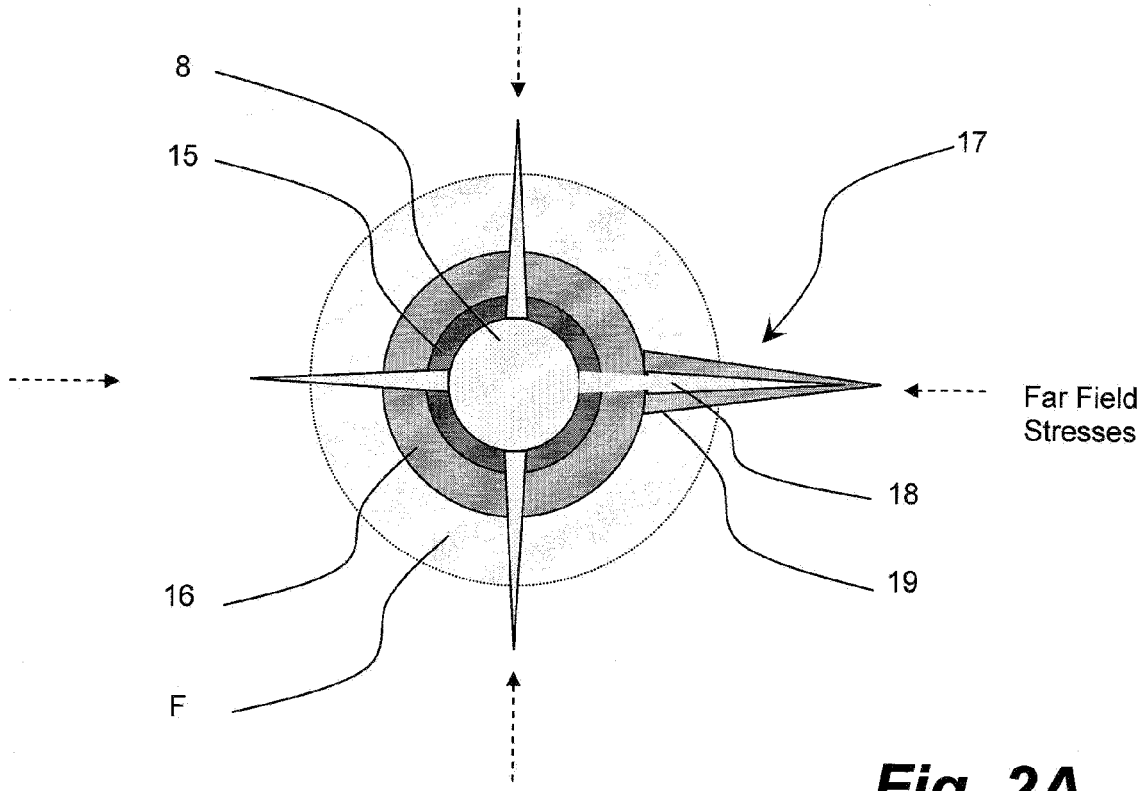
FIG. 2A is a top, cross-sectional view of a perforated wellbore with detail of a one of a plurality of perforation tunnels.
Figure 2B:
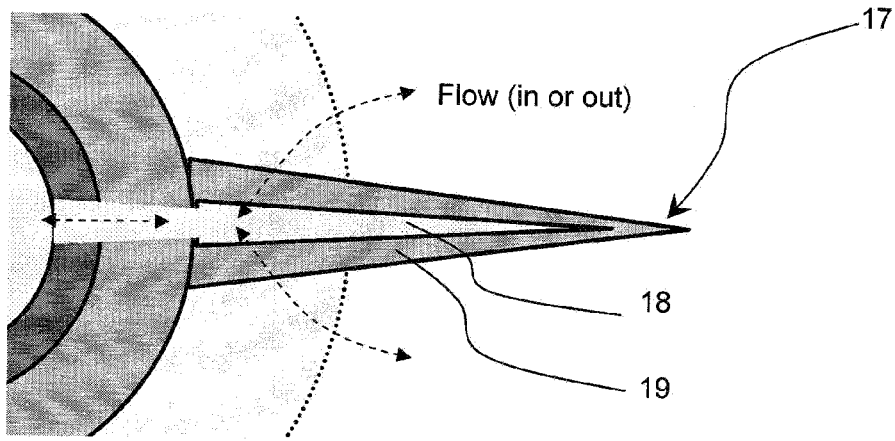
FIG. 2B is a partial view of a close up of the detailed perforation tunnels of FIG. 2A.

As shown in FIGS. 1-2B, a cased wellbore 12 comprises casing 15 and cement 16 between the casing 15 and the formation F. With reference to FIGS. 2A and 2B, upon perforation the casing 15, the cement 16 and the formation F are penetrated by perforations 17. Each perforation 17 can be generally characterized as comprising a cavity 18 surrounded by perforation damage in a crushed region 19 about the perforation 18. The perforation cavity 18 can include debris such as that from the crushed region 19 which can be a least partially cleaned through the creation of the dynamic underbalance.

Figure 3B:
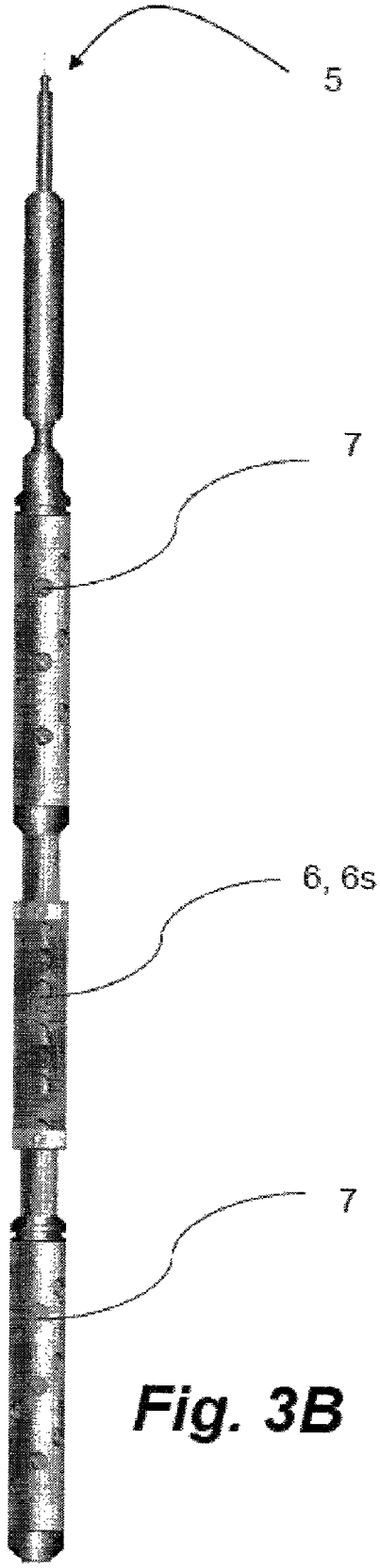
FIG. 3B is a side view of an embodiment of the present invention, illustrating a perforation gun, shown fit with a sleeve-type propellant configured on the outside of the gun, and surge canisters fit uphole and downhole from the gun.
Figure 4A:
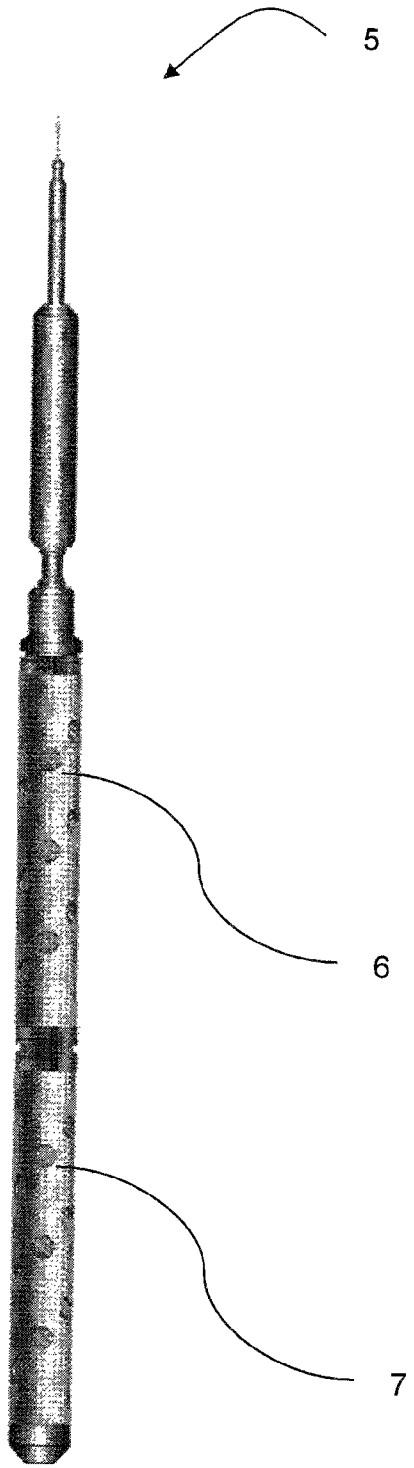
FIG. 4A is a side view of another embodiment of the present invention with a surge canister downhole of a perforating gun which is fit with propellant configured on the inside of the gun.
Figure 4B:
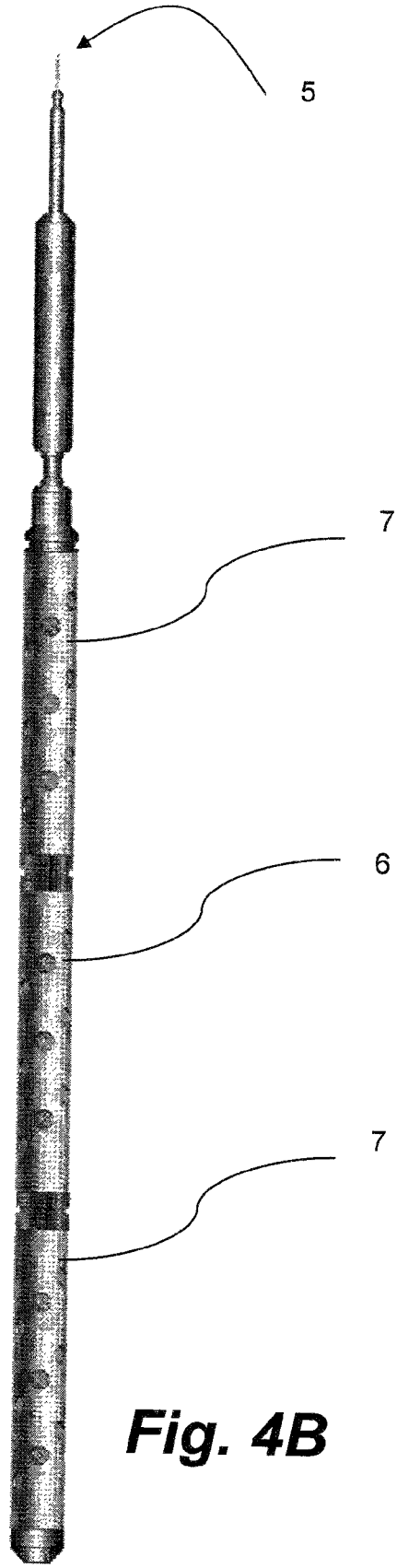
FIG. 4B is a side view of another embodiment of the present invention with a surge canister uphole and downhole of a perforating gun fit with propellant on the inside of the gun.

With reference to FIGS. 1, 3A, 3B, 4A and 4B, the assembly 5 can comprise one or more canisters 7 located above or below the perforating gun 6. FIGS. 1 and 3A illustrates one canister 7 below the perforating gun 6 and FIG. 3B illustrates one canister 7 above and one canister 7 below. FIGS. 4A and 4B illustrate different forms of perforating guns 6 having one canister 7 below the perforating gun 6 (FIG. 4A) and another having one canister 7 above and one canister 7 below (FIG. 4B). It is contemplated to use a plurality of canisters 7 and canisters 7 of differing volumetric capacities, limited only by the perforating gun 6, conveyance means and wellbore characteristics.

Figure 7A:
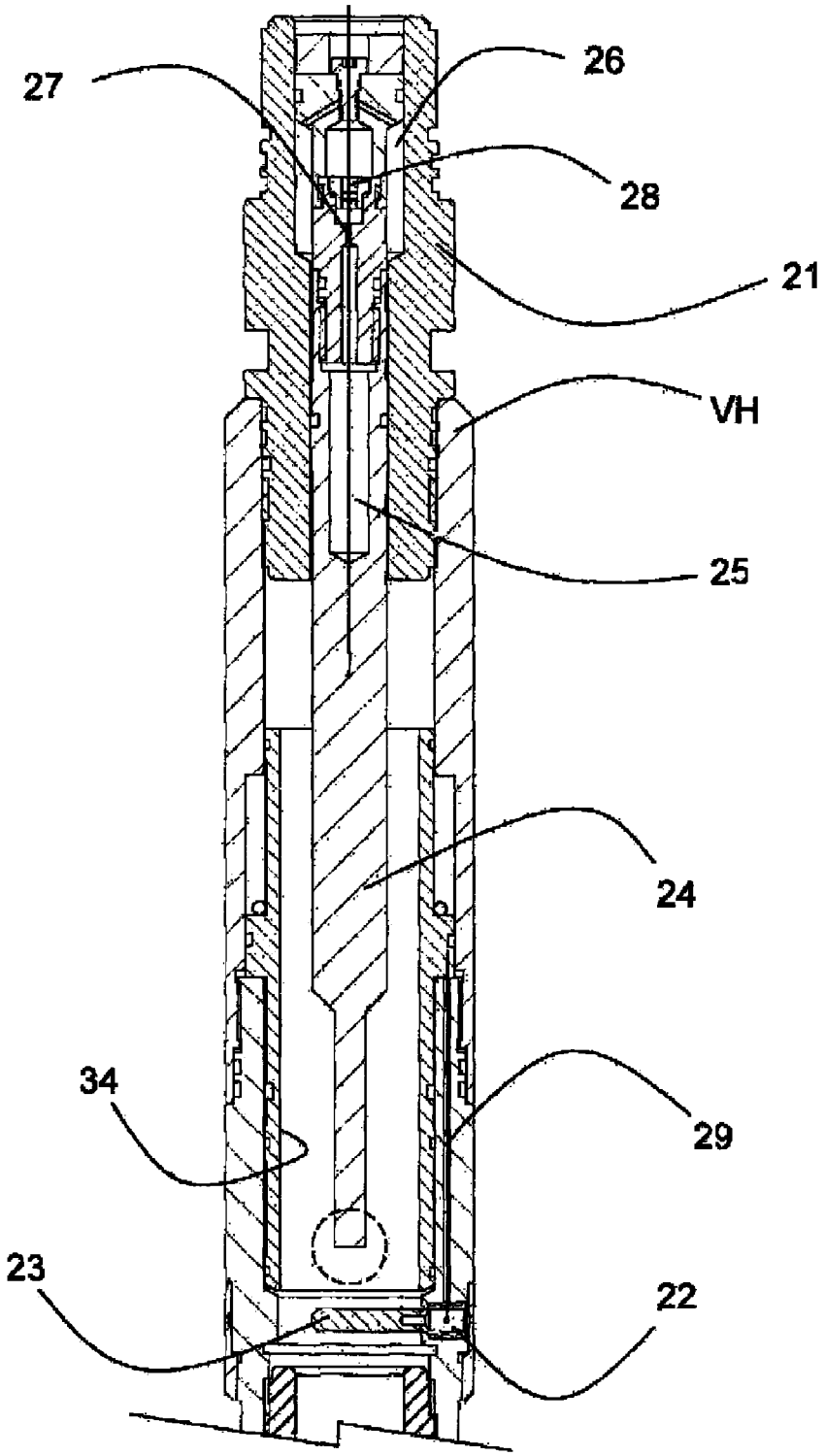
FIGS. 7A through 7C are cross-sectional side views of the trigger device for illustrating three sequential steps of actuation of the trigger device. More particularly.
Figure 7B:
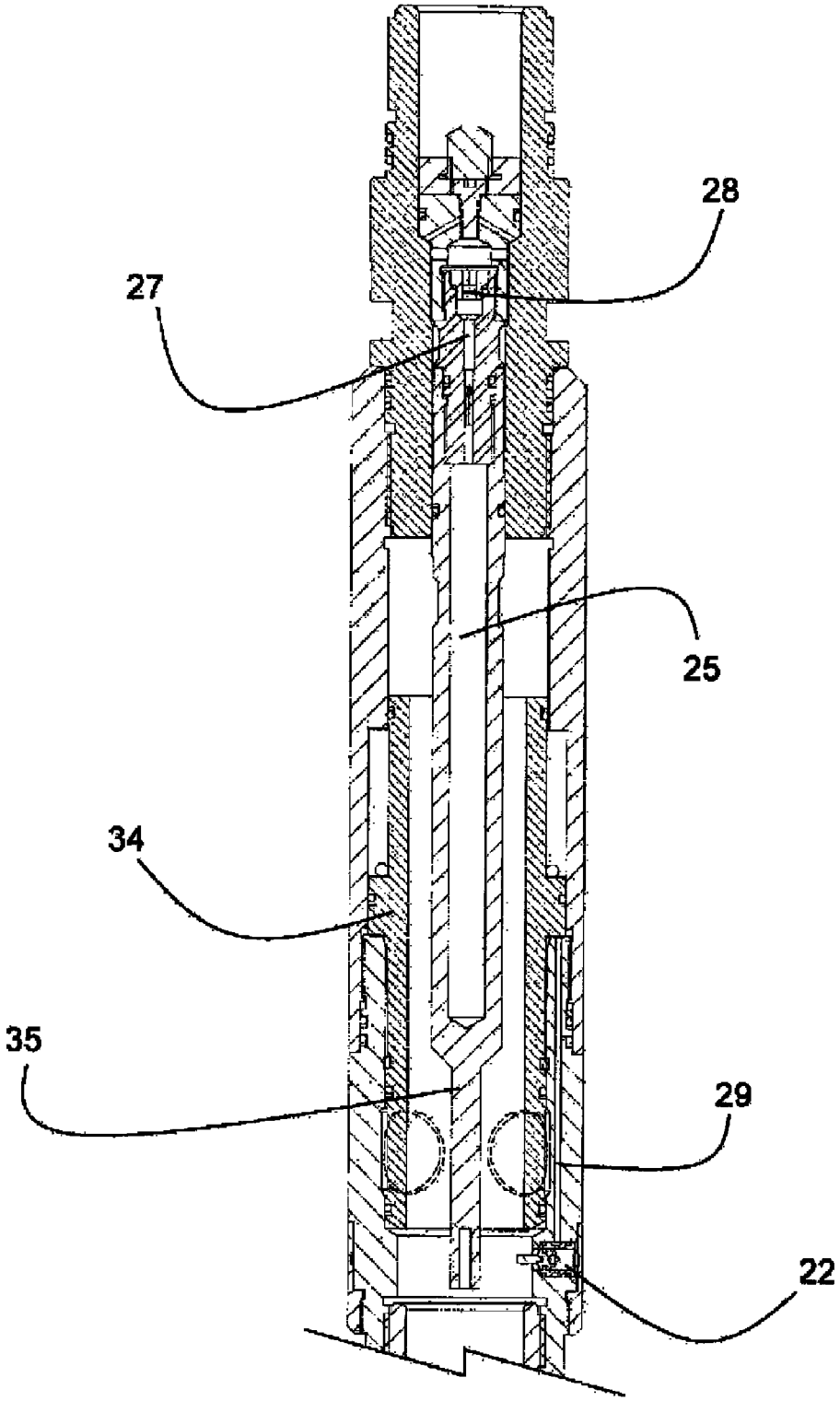
Figure 7C:
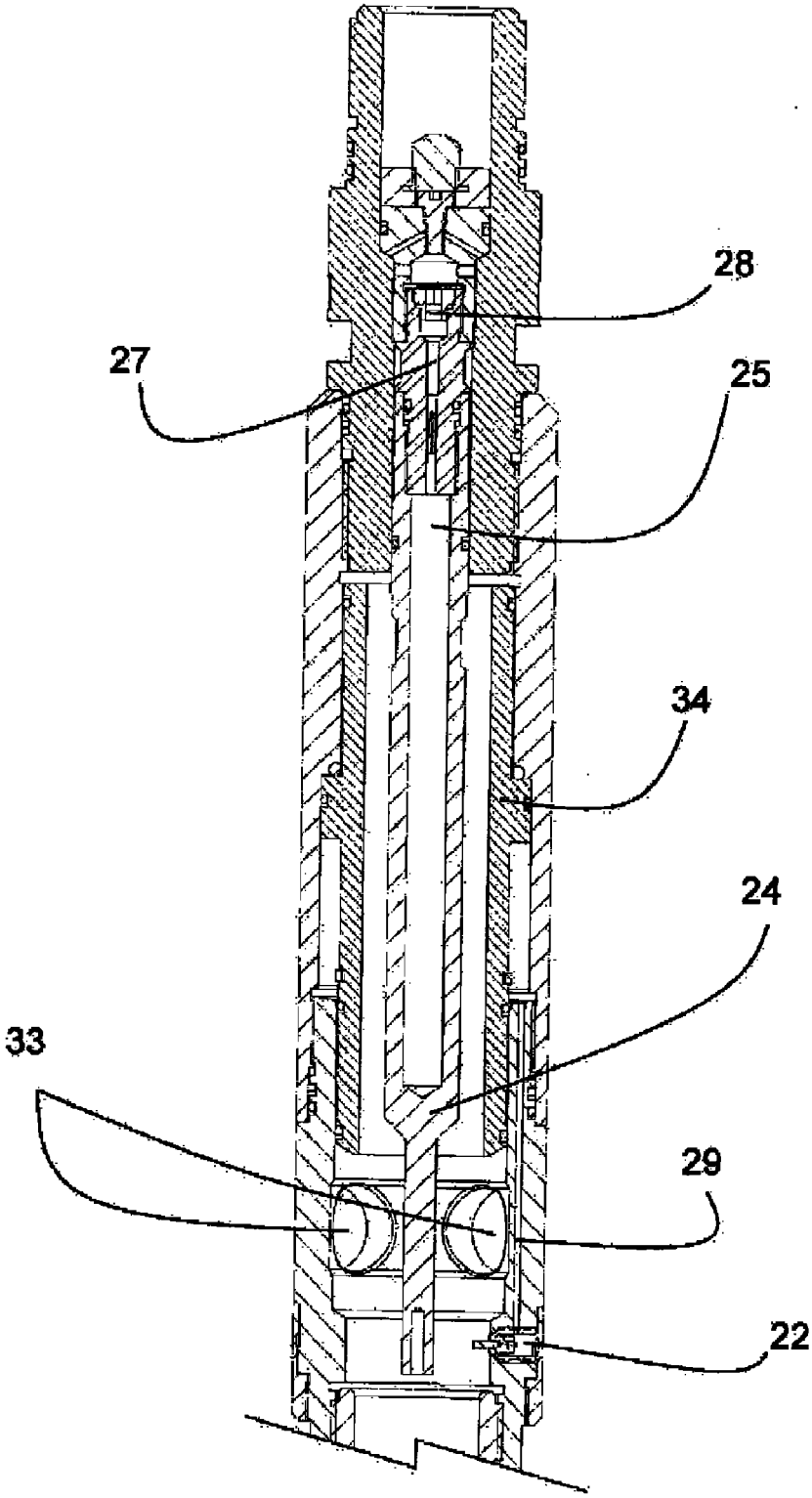

With reference to FIGS. 5, 6 and FIGS. 7A-7C, the canister 7 is fit with a trigger device 20 which is actuable to actuate the canister 7 between the closed position (FIG. 7A) and the open position (FIG. 7C). The trigger device 20 can be configured to actuate one or more canisters 7. The embodiment shown herein illustrates the trigger device 20 for actuation of one canister 7. As shown in this embodiment, the canister 7 is connected to the trigger device 20 and the canister 7 can be seen to comprise a housing 30 and a volume or chamber 32 therewithin (FIG. 5) for receiving fluids. The chamber 32 is otherwise closed except for a fluid connection between the chamber 32 and the trigger device 20. Suitable canisters can include empty perforating carriers as illustrated in FIGS. 1-4B.

The chamber 32 typically contains only gas at atmospheric pressure such as that set at surface before insertion into the wellbore 8. Air or inert gas at surface conditions or atmospheric pressure provides an initial canister pressure which is significantly less than most wellbore conditions encountered at the zone of interest 10.

The trigger device 20 actuates the canister 7 between the closed position (FIG. 7A) for excluding fluids in the annulus 11 and the open position (FIG. 7C) for establishing communication between the chamber 32 and the annulus 11 for admitting fluids and causing a temporary or dynamic pressure imbalance in the annulus 11 at the zone of interest 10. Herein, the trigger device 20 is described in the context of a pressure-actuated device. Electrically operated and remote actuated downhole devices are also known to those of skill in the art. The trigger device 20 can be set for inherent triggering due to changes in wellbore conditions after perforating, by a pre-determined time delay or by some other means.

With reference to FIGS. 5-8B, one embodiment of the trigger device 20 is a pressure actuated valve 20V connected to the canister housing 30. The valve 20V comprises a valve housing VH and a valve bore VB. The valve bore VB is in fluid communication with the canister chamber 32 and the valve housing VH is exposed to the annulus 11. One or more fluid ports 33 formed in the valve housing VH are alternatively blocked to isolate the canister chamber 32 (the closed position) by a valve sleeve 34, and opened to establish communication therethrough between the valve bore VB and the wellbore 8 (the open position).

With reference to FIG. 6 and FIGS. 7A-7C, and as discussed in greater detail herein, a suitable valve 20V is a pressure actuated valve such as that responsive to an initial elevated pressure P1 originating from the original actuation of the perforating gun 6 or burning of propellant of a stimulation gun creating an initial pressure event. A timing mechanism or timer delays the actuation of the valve 20V to some pre-determined delay. As shown, the timing can be based upon various sizing of components in the valve 20V. One embodiment of a timer employs the principles of fluid flow metered through a fluid orifice to retard actuation of a timing piston 24 over a time period.

The valve 20V has a body 21 fit with the timer. The timer comprises an annular fluid reservoir 26 containing a metering fluid, such as oil, in fluid communication with a dump chamber 25. A timing piston 24 is fit to the reservoir 26 and is movable therein. Ported within the piston 24 and situated between the reservoir 26 and the dump chamber 25 within the piston 24 is a rupture disc 28 and a control orifice 27. Upon a rise in pressure to a pre-determined pressure such as the initial elevated pressure P1, the pressure acts on the piston 24 to drive the piston 24 into the reservoir 26, raising the reservoir's pressure until the rupture disc 28 is caused to rupture, allowing fluid from the reservoir 26 to flow at a controlled rate through the control orifice 27 and into the dump chamber 25, thus enabling the piston 24 to move axially in the valve body 21 over time. A period of time is required for the fluid to flow from the reservoir 26 to the dump chamber 25 resulting in a time delay after the initial elevated pressure event for the piston 24 to move sufficiently to actuate the trigger device 20. The duration of the time delay is substantially governed by factors including the diameter of the control orifice 27.

The reservoir 26 is an annular reservoir between the timing piston 24 and the valve body 21. As shown in FIG. 7A, as the metering fluid passes from the reservoir 26 to the dump chamber 25, the piston 24 is able to move axially along the valve body 21 from the closed position (FIG. 7A) to a triggering position (FIG. 7B) for actuating a valve sleeve 34 to shift from the closed to the open position (FIG. 7C).

Figure 5:
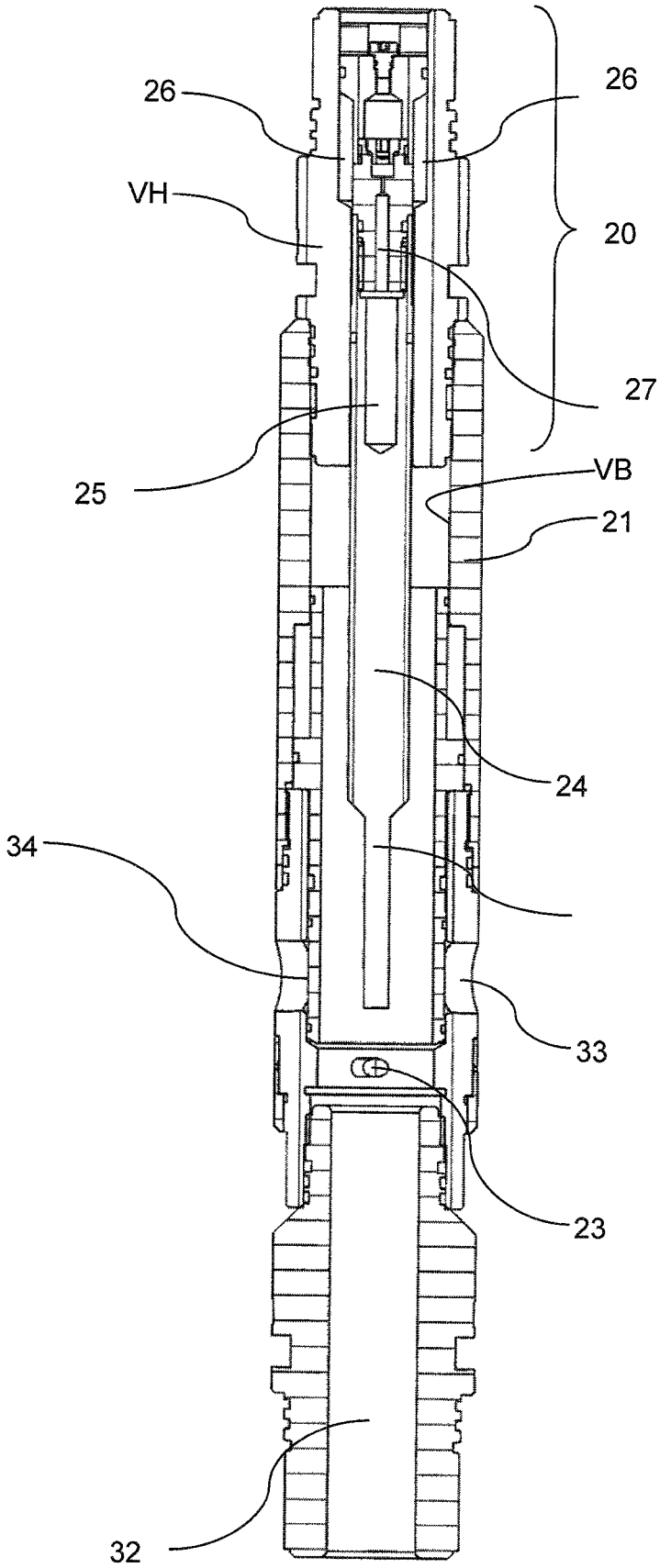
FIG. 5 is a cross-sectional view of a pressure actuated trigger device according to one embodiment of the present invention which is coupled to one end of a surge canister.
Figure 6:
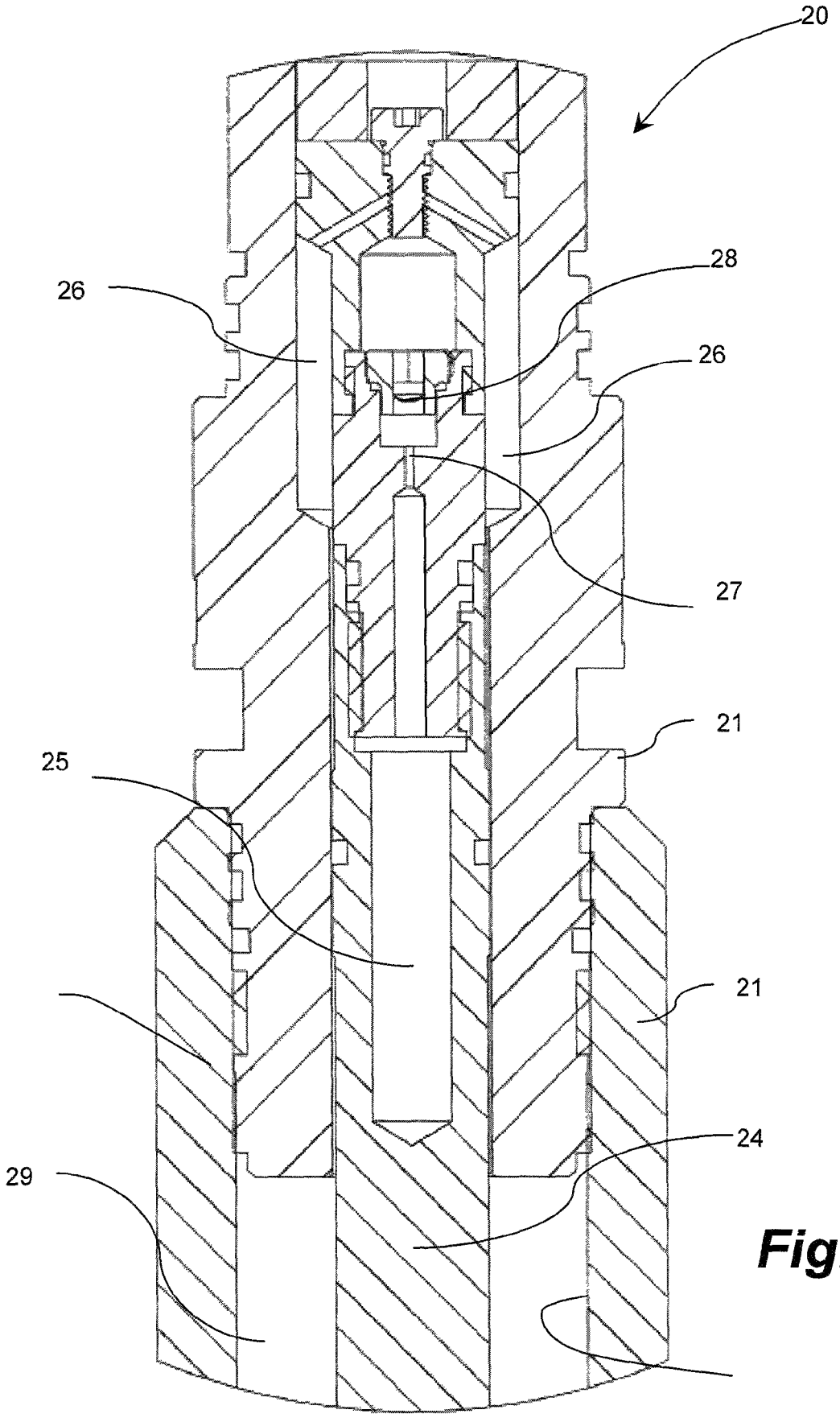
FIG. 6 is an enlarged view of the trigger device of FIG. 5.

As shown in FIGS. 5 and 7A, a protrusion 35 extends axially from the piston 24. The one or more ports 33 are closed and opened by axial movement of the valve sleeve 34 which normally blocks the one or more ports 33 (shown in dotted lines) in the closed position. The valve sleeve 34 is a hydraulically operated piston axially movable in the valve bore VB. As the timing piston 24 moves axially, the protrusion 35 approaches and ultimately actuates a trigger 23 for enabling fluid pressure from the annulus 11 to shift the valve sleeve 34 to the open position. An actuating passage 29 extends between the valve sleeve 34 and the annulus 11 for establishing a pressure differential across the valve sleeve 34 and shifting the valve sleeve 34 to the open position. Normally, the actuating passage 29 is isolated from the annulus 11 using a trigger port plug 41. The timer determines the release of the trigger port plug 41 and actuation of the valve sleeve 34.

Figure 8A:
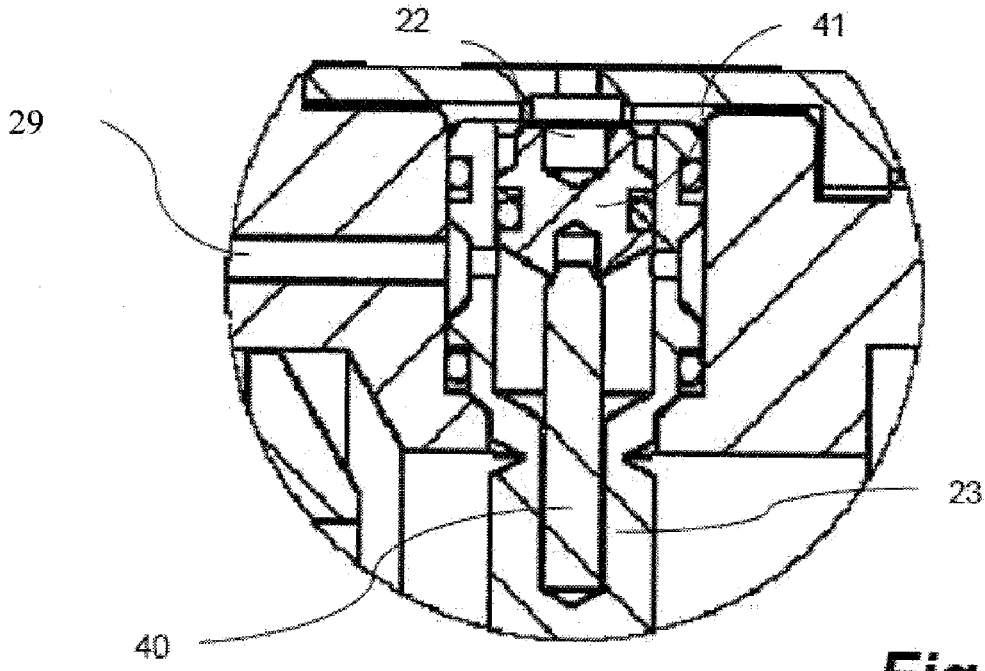
FIGS. 8A and 8B are enlarged partial cross-sectional views of a trigger port plug before actuation and after actuation respectively.
Figure 8B:
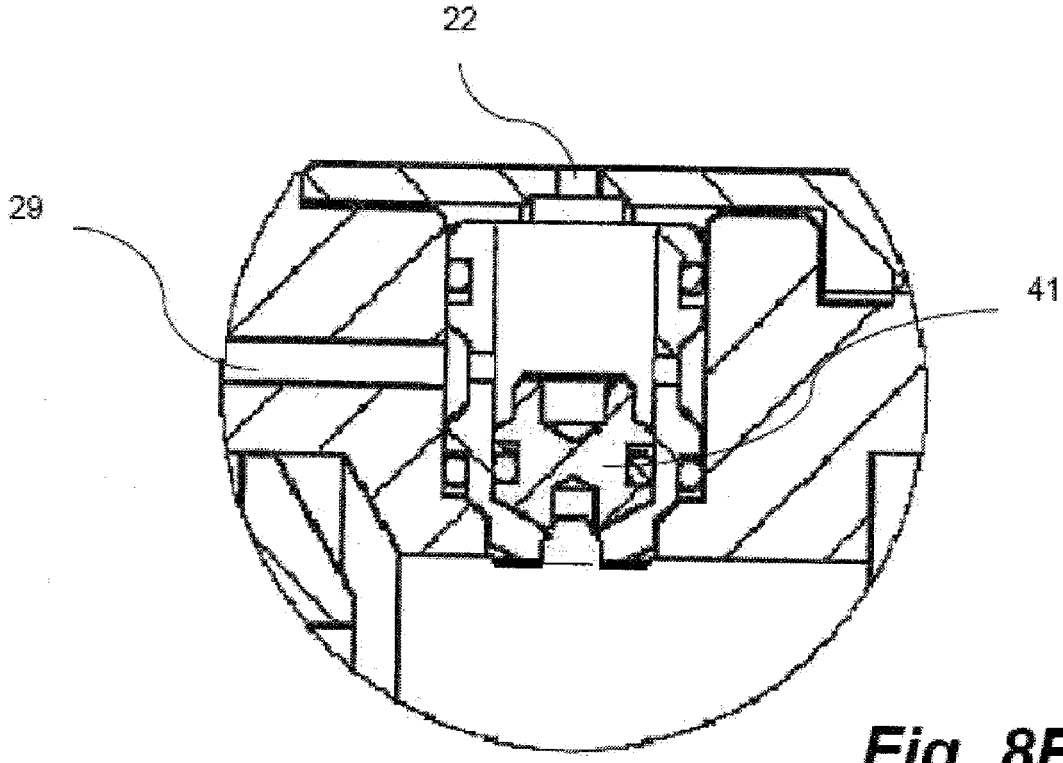

In one embodiment, and in more detail in FIGS. 8A and 8B, the trigger port plug 41 is a piston temporarily supported in a laterally-extending cylinder or plug port 22 to isolate the actuating passage 29 from the annulus 11. The plug 41 is axially restrained in the plug port 22 by a support member 40 extending between the trigger 23 and the plug 41. The trigger 23 is a bar which is structurally weakened or frangible and which extends laterally inwards from the valve housing VH in the valve bore VB to impinge upon an axial path of the timing piston's protrusion 35.

As shown in FIG. 7B, as the fluid from the reservoir 26 is metered into the dump chamber 25, the piston 24 moves axially and the volume in the reservoir 26 decreases. When enough metering fluid has moved from the reservoir 26 to the dump chamber 25, the piston 24 can contact and break the trigger 23. When the trigger 23 breaks, the supporting member 40 is released for enabling the plug 41 to shift in the plug port 22 and fluidly connecting the annulus 11 and the actuating passage 29.

With reference to FIG. 7C, the valve sleeve 34 is actuated to open the ports 33 and allow fluid communication between the annulus 11 and the chamber 32.

In operation, the timing of the delay can be pre-determined or related to in-situ conditions.

With reference once again to FIG. 1, in one embodiment the perforating gun 6 can be configured with a propellant sleeve 6*s*, the combination being also known in the industry as a stimulation gun (propellant-assisted type perforating gun). One form of a stimulation gun is the StimGun™ available from Marathon Oil Company and subject of U.S. Pat. No. 6,082,450 to Snider et al. Applicant notes that the propellant can burn more efficiently at elevated pressures such as those at the initial pressure event P1. Accordingly, in this embodiment, the time delay can correspond to the optimal burning of the propellant. Note that several embodiments of the invention can utilize a relatively small diameter perforating gun assembly 5 which utilizes a propellant carried either on the outside of at least a portion of the length of the gun 6, such as in the form of the propellant sleeve 6*s* (See FIGS. 3A and 3B), or inside the perforating gun assembly 6 (See FIGS. 4A and 4B).

As shown in FIGS. 3A and 3B, the stimulation gun typically comprises a cylindrical sleeve 6*s* of gas-generating propellant that is installed over the outside of conventional hollow steel carrier perforating gun 6. A diameter of each surge canister 7 can be chosen to be substantially the same diameter as the outside diameter of the propellant sleeve 6*s* and the diameter of the perforating gun 6 is slightly smaller so as to accommodate the propellant sleeve 6*s*. If the propellant however is housed inside the perforating gun 6 (FIGS. 4A and 4B), the perforating gun diameter and surge canister diameter could be substantially the same.

The propellant is ignited by the pressure and shock wave of shaped charges leaving the perforating gun 6 for penetrating the casing 12 and/or the formation F. The actuation or detonation of the perforating gun 6 can be initiated by conventional electric line or tubing conveyed techniques. When the shaped charges are detonated, the propellant sleeve 6*s* is ignited within an instant, producing a burst of high pressure gas as the initial pressure event having an initial elevated pressure P1. An earlier and very short pressure spike may be noted resulting from the detonation. In the case of a stimulation gun, the following rise in annulus pressure due to the high pressure gas is deemed the initial elevated pressure event.

The propellant is permitted to be substantially completely consumed. The time delay for opening the canisters 7 can be adjusted based upon the propellant characteristics and the annular volume about the perforating gun 6.

The combustion of the propellant is most effective under the containment of fluid pressure, hence these embodiments' use of initial overbalanced conditions. While the conventional perforating gun 6 perforates the casing 12 and affects the formation F, the high pressure gas from the propellant enters the perforations 17 and further conditions the formation F, creating fractures. In hard rock formations, fractures can extend radially a distance of many feet from the wellbore 8.

Once the propellant has been utilized to maximum advantage in stimulating the formation F about the wellbore 8, the canisters 7 are actuated to open and create the dynamic underbalance and an in-rush of fluid and gas from in the formation F which surges into the wellbore 8, carrying particulate debris and fines out of the formation F. In one embodiment, a time delay can be pre-determined to enable sufficient time for the propellant to burn and maximize the formation of perforations 17.

In another embodiments, which are independent of the type of perforating gun 6, the time delay before opening of the surge canisters 7 can be pre-determined to coincide or correspond generally to some other time or wellbore condition.

It is noted that in the prior art, use of perforating guns alone can result in an inherent depression of the annulus pressure once the initial elevated pressure event (the detonation for conventional perforating guns, and the end burning phase for stimulation guns) has ended. Embodiments of the present invention enhance the underbalanced condition that may or may not occur inherently due to the characteristics of the gun 6 and wellbore 8 themselves.

As discussed above, and as shown in FIGS. 12 and 15, the particular time delay after perforation can be pre-determined in advance of positioning the downhole assembly 5 in the wellbore 8 such as to configure the timer to open one or more of the surge canisters 7 a pre-determined time delay after the first, initial elevated pressure P1. An effective time delay is such that the initial elevated pressure event is substantially complete as evidenced by a diminishing of the dynamic pressure to approach a second threshold pressure P2 which is lower than the first initial elevated pressure P1 and when dynamic pressure is about the initial hydrostatic pressure P0.

While the effective time delay can be pre-determined as a time value long enough to distinguish the dynamic pressure from the initial pressure event, the pre-determined time delay can also be pre-determined to substantially coincide with more specific and desirable wellbore conditions.

The second threshold pressure P2 can be pre-determined to be at a dynamic pressure which is lower than the initial elevated pressure P1 and upon introduction of a dynamic underbalance through opening of the one of more canisters 7, enhancing one or both of either of the magnitude of the underbalance, or the duration thereof.

The threshold pressure P2 can include pressure at or about the initial hydrostatic pressure P0, or some other lower inherent pressure, pressure inflection or as introduced below, the threshold pressure P2 is timed to occur relative to a third, interface reflection pressure wave P3 traveling through the wellbore fluid.

The length of the pre-determined time delay can be calculated so as coincide with the dynamic pressure in the wellbore 8 approaching a desired or pre-determined threshold pressure P2. In other words, the one or more canisters 7 are opened at the pre-determined threshold pressure P2. The calculations can be based upon factors known to those of skill in the art including a calculated duration of the initial elevated pressure event and propagation of pressure waves through a particular wellbore 8.

In one embodiment the threshold pressure P2 can be when the dynamic pressure is at or near the initial hydrostatic pressure P0. In other embodiments, the threshold pressure P2 is related to the third interface reflection pressure wave P3. For example, the time delay can precede the pressure wave P3 by opening the one or more surge canisters 7 for lowering the dynamic pressure below the threshold pressure P2 resulting in an dynamic underbalance, followed by a further pressure depression resulting from the pressure wave P3, sustaining the dynamic underbalance. Other embodiments include timing the time delay so as to coincide with the pressure wave P3 which can result in a greater magnitude of the depression of the dynamic pressure, sustaining the period of dynamic underbalance or both. Other embodiments include timing the time delay so as to open the one or more canisters 7 some time after the pressure wave P3 for accentuating the magnitude of the depression of the dynamic pressure, sustaining the period of dynamic underbalance or both.

The pressure of the third pressure wave P3 can be less than, or, at or near the second threshold pressure P2. In other cases the third pressure wave P3 may be greater than the second threshold pressure P2

In other embodiments, and while supporting apparatus is not discussed herein, the triggering after a time delay can be dynamic based upon measurements of conditions including the initial hydrostatic pressure P0, downhole in-situ measurements of wellbore pressures P1,P2,P3, and calculations based thereon. Those of skill in the art can specify sensors that suit the environment.

With reference again to FIG. 11 and also to FIGS. 12 through 18B each the canisters 7 can be opened at various time delays after firing of the perforating gun 6, resulting in varying effects on the formation including dynamic underbalanced conditions of increased magnitude or a series pulsed of one or more dynamic underbalanced conditions. Two or more surge canisters 7 can be actuated in parallel, to enhance the dynamic underbalance such as the rate of change of the pressure depression and underbalanced duration, and others can be opened in series to step wise enhance the dynamic underbalance.

Maximal underbalance appears to occur once any inherent underbalance has reached a maximum depression and thereafter further lowering the pressure through introduction of a dynamic underbalance by opening one or more of the canisters. Maximal effect on a formation is related to formation characteristics and one formation way respond more positively to rate of change of pressure, magnitude of the underbalance or duration of underbalance, all of which or combinations of which are available using the one or more surge canisters and the time of their actuating.

One form of inherent underbalance occurs from the synergistic return of a pressure wave created from the perforating. While a minor pressure wave can result from a conventional perforating gun and depress the pressure profile slightly, the use of a propellant-type perforating gun produces a significant and initial high pressure event. This initial elevated pressure event P1 creates a significant pressure wave that radiates away from the source of detonation. This wave may be reflected off an uphole interface of the fluid in the annulus and gas space thereabove, or off a downhole interface between the fluid in the annulus and either a downhole tool or the bottom of the wellbore. Modeling data has shown that this interface reflection pressure wave returns to the zone of interest and has an affect on the conditions in the annulus. The return of this pressure wave coincides with a greater amplitude in depression of the pressure, being an enhancement of the underbalanced condition.

Further, isolation of the zone of interest after the arrival of this pressure wave even further increases the amplitude of the underbalance condition.

Figure 9:
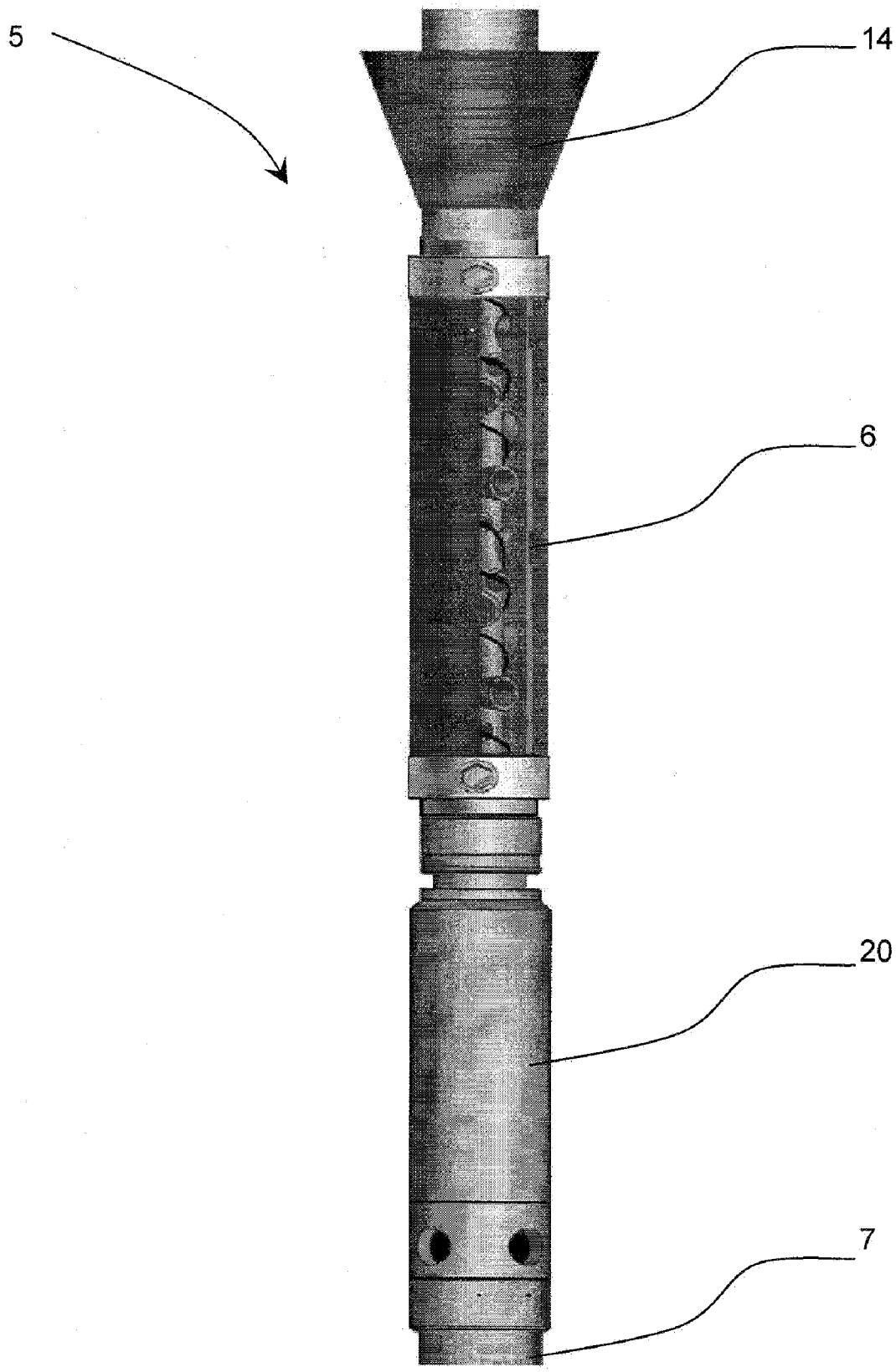
FIG. 9 is a side view of an embodiment of the present invention shown with an optional pressure wave attenuator in its open position, the wellbore being omitted in this view.

With reference to FIG. 9, in another embodiment a pressure wave attenuator 14 is placed near the top end of the assembly 5. The pressure wave attenuator 14 acts as a flow reducer to temporarily isolate the zone of interest 10. In one embodiment, once a beneficial interface reflection pressure wave depresses the pressure about the zone of interest 10, the attenuator 14 can be actuated to isolate the zone of interest 10 from the fluid head thereabove and thereby increasing the dynamic underbalance inducing event. The attenuator 14 can be associated with a perforating gun break for ensuring the assembly remains in place while the attenuator 14 is active. In an embodiment, the attenuator 4 can be actuated by the pressure differential formed in the annulus 11 by passing of the reflection pressure wave. Once the differential pressure across the attenuator 14 equilibrates, the attenuator 14 and brake can release.

Delayed after perforation, it is noted that the surge canisters 7 may be opened earlier or later, however, opening of the canisters 7 prior to the substantially complete burning of a propellant can result in a diminished stimulation effect on the formation F.

Further, it is noted that the period of dynamic underbalanced condition may be extended, lengthening the period of time for particulate and formation debris to be withdrawn from the formation fractures. Such extensions can be achieved by creating subsequent underbalance induction events, such as the actuation of subsequent surge canisters 7. Subsequent canisters 7 can be actuated from the surface to coincide with the eventual decrease in the underbalance condition, as the pressure differential between the annular fluids and the fluid pressure in the formation F equalize, creating a refreshed underbalance condition, and extending the period of underbalance.

EXAMPLES

A variety of different perforation guns and canister actuation times were modeled using PulsFrac™ software available from John F. Schatz Research & Consulting, Inc., Del Mar, Calif. and www.pulsfrac.com. Each graph illustrates an initial overbalanced pressure, a pressure spike upon actuation of the perforating gun and a diminishing pressure as the propellant is consumed. At a threshold pressure, or time, the surge canisters were actuated to create a void in the bore of the casing.

A series of examples were modeled using a controlled wellbore depth of 2900 meters, drilling for methane in a sandstone lithology with a porosity of 9% and a permeability of 0.1 mD. The assembly was positioned at approximately 2566 to 2570 m in depth in a water fluid depth of 345 m. The modeling data used to created the following graphs further controlled the formation pressure at 22 MPa.

The assembly comprised of a 4 meter perforating gun and had a nominal 4 inch (101.6 mm) diameter canister having a length of 10 meters for running into a 5.5 inch (139.7 mm) cased wellbore. The valve was fit with four 1.38 inch diameter surge ports.

The initial detonation of the perforating gun caused a dramatic increase in the annular pressure. This dynamic pressure decreases from the initial pressure event as the propellant from the perforating gun substantially burns out, the rate of change of dynamic pressure and dynamic pressure both diminishing over time with the dynamic pressure approaching to the initial hydrostatic pressure, either directly or cycling about the initial pressure. Substantially complete burning of the propellant, in the examples shown, appears to occur at about 0.038 s following gun detonation.

Applicant's induced dynamic underbalanced condition occurs after substantial completion of the initial pressure event. The duration of underbalance vary somewhat dependent upon the timing of the time delay before opening, the dynamic pressure appearing to return to hydrostatic pressure at about the same time following opening of the chambers, regardless of when the chambers were opened. Further, opening of the chambers 1 second or 60 seconds has similarly produced the underbalanced condition. Applicant hypothesizes a limit however which may be related to the eventual cessation of the dynamic nature of the formation after perforation.

As known, documentary evidence has shown that there is both benefit to extreme overbalanced perforating in that all of the perforations can be effectively broken down and a short fracture of the formation can be generated at the time of perforating; and to underbalanced perforating in order to flow back debris in the perforating tunnel and to disrupt the compaction zone around the perforation tunnel. Herein, the propellant-assisted dynamic underbalance perforating is able to provide both effects in a controlled, virtually simultaneous event.

Example 1

Prior Art

Figure 10:
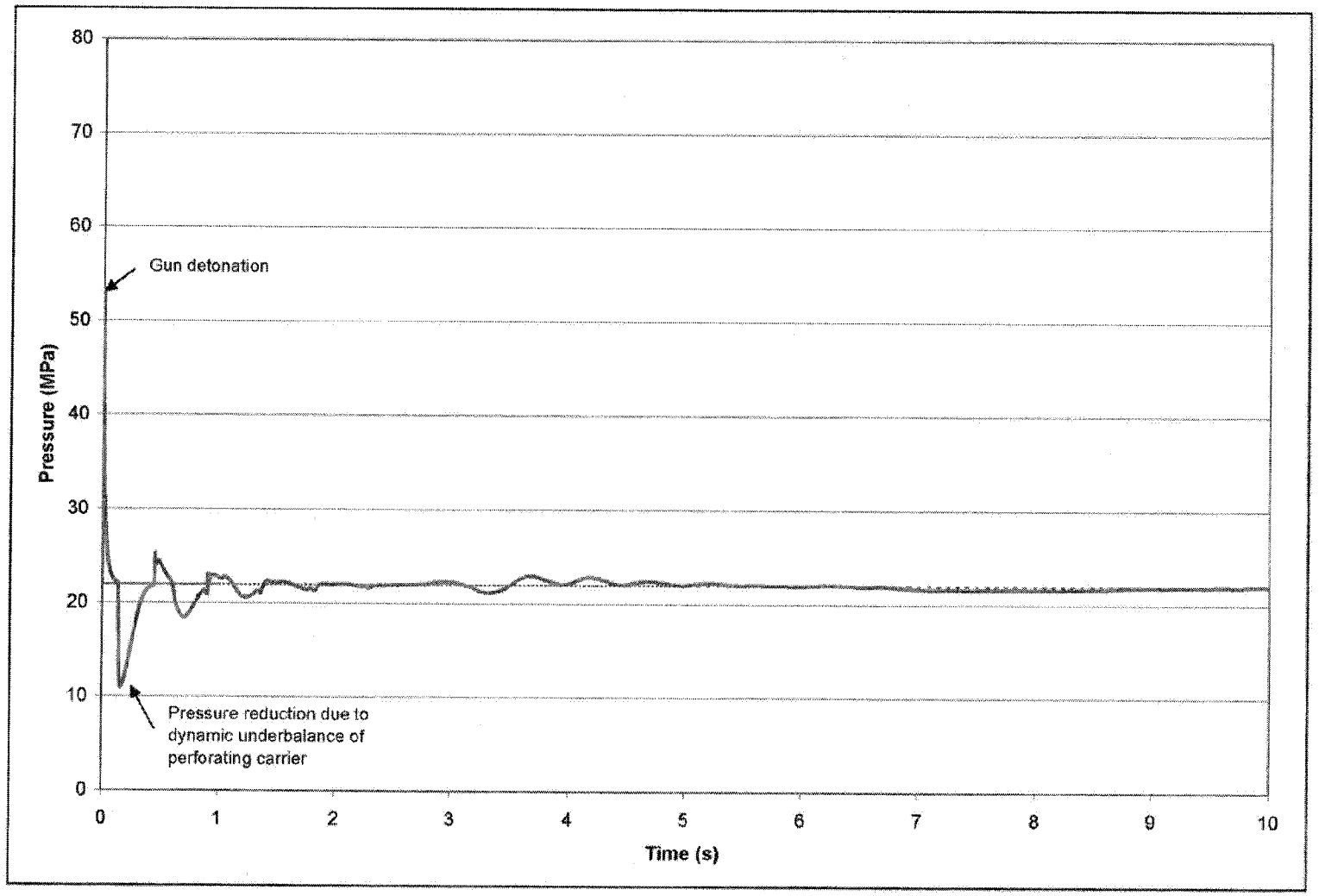
Fig. 10 Prior Art
FIG. 10 is a graph illustrating a modeled pressure profile resulting from a prior art detonation of a perforating gun according to Example 1.

With reference to the prior art of FIG. 10, a pressure profile of the firing of a conventional non-propellant perforating gun is illustrated.

As shown, there is an initial overbalanced pressure event caused by the burning and detonation, followed by a short period of an underbalanced condition inherent in the behavior of perforating. The resulting pressure profile demonstrates that the conditions in the wellbore are dynamic and the amplitude of an inherent underbalance which naturally occurs after perforating diminishes very quickly over time and certainly less than 1.5 s. Interestingly, approximately 3 seconds after the detonation, there was demonstrated a very weak perturbance in the pressure profile. Applicant hypothesized that this perturbance was created by an interface reflection pressure wave returning to the zone of interest. Applicant utilizes this reflection pressure wave in later embodiments of the invention.

Example 2

Prior Art

Figure 11:
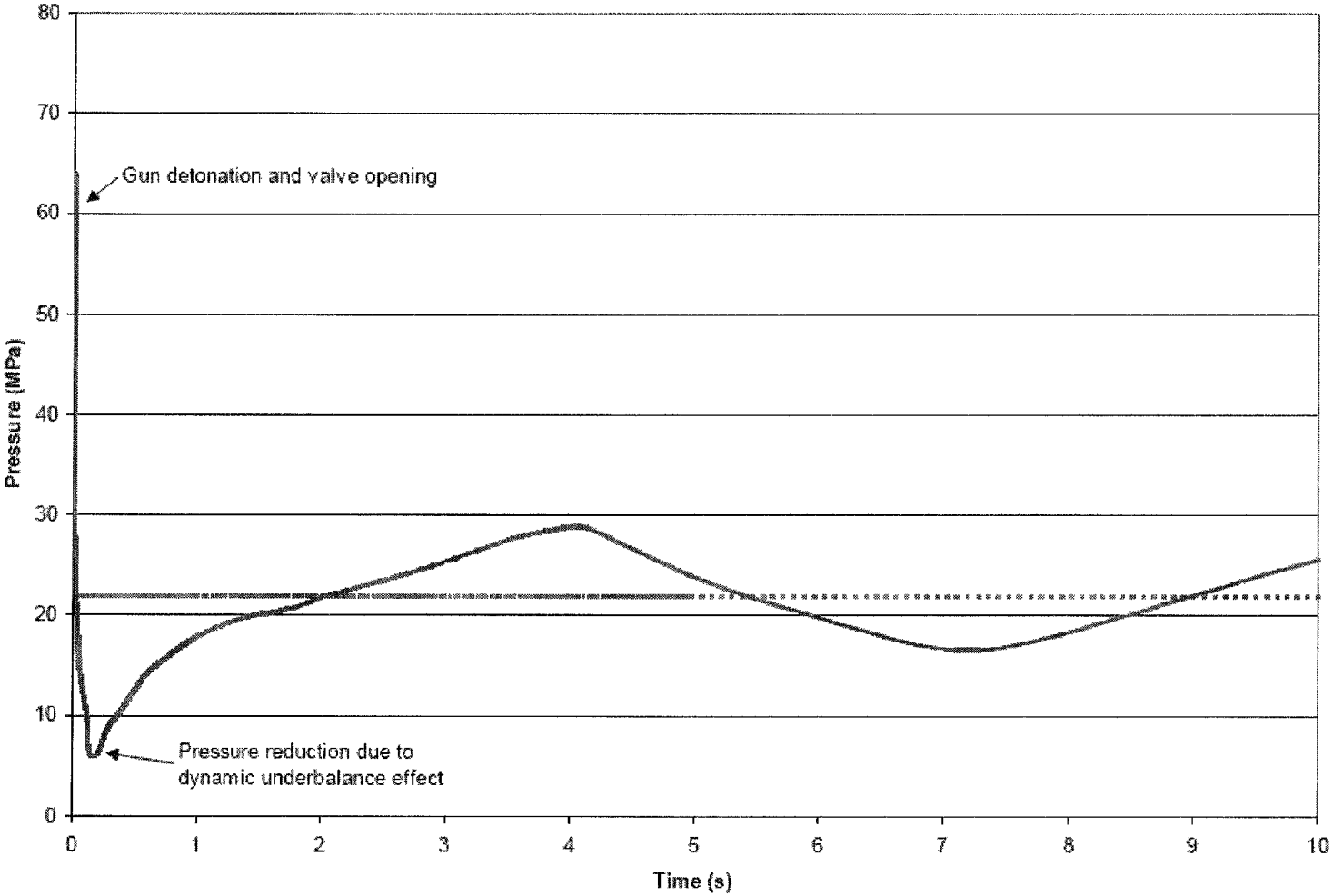
Fig. 11 Prior Art
FIG. 11 is a graph illustrating a modeled pressure profile resulting from a prior art detonation of a perforating gun with a simulated creation of a void according to the prior art according to Example 2.

FIG. 11 also illustrates modeling of the prior art for a pressure profile of an assembly comprising a non-propellant perforating gun and a canister that forms a void simultaneously upon the detonation of the gun. Any dynamic underbalance is again short lived and less than 2 s.

Example 3

Figure 12:
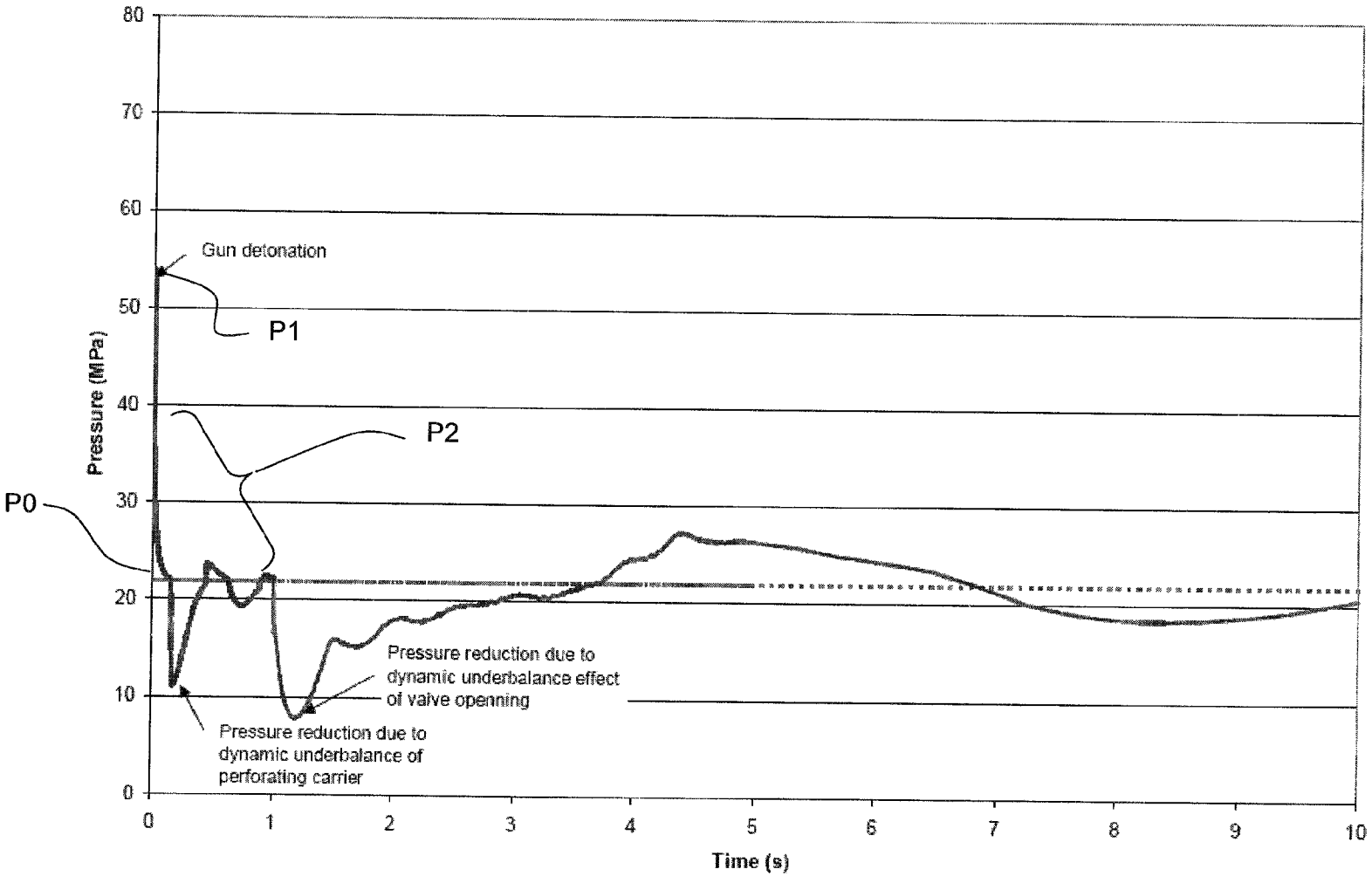
FIG. 12 is a graph illustrating a modeled pressure profile according to one embodiment of the invention resulting from a detonation of a perforating gun followed by the opening of a surge canister after a 1 second time delay according to Example 3.

In an embodiment of the invention, with a view to enhancing the dynamic underbalance, a surge canister is opened after a time delay. As shown in FIG. 12, the surge canister is opened one second after detonation of a non-propellant perforating gun. As demonstrated, two underbalance-inducing events occurred; the inherent underbalance from the initial detonation of the perforating gun; and the dynamic underbalance from the opening of the surge canister. The first underbalance event is short lived, lasting approximately 0.5 seconds with a minor oscillation ending at about 1 s. The second dynamic event according to a method of the invention, demonstrated a greater amplitude and sustained the underbalance for a further 2.8 s.

Example 4

Prior Art

Figure 13:
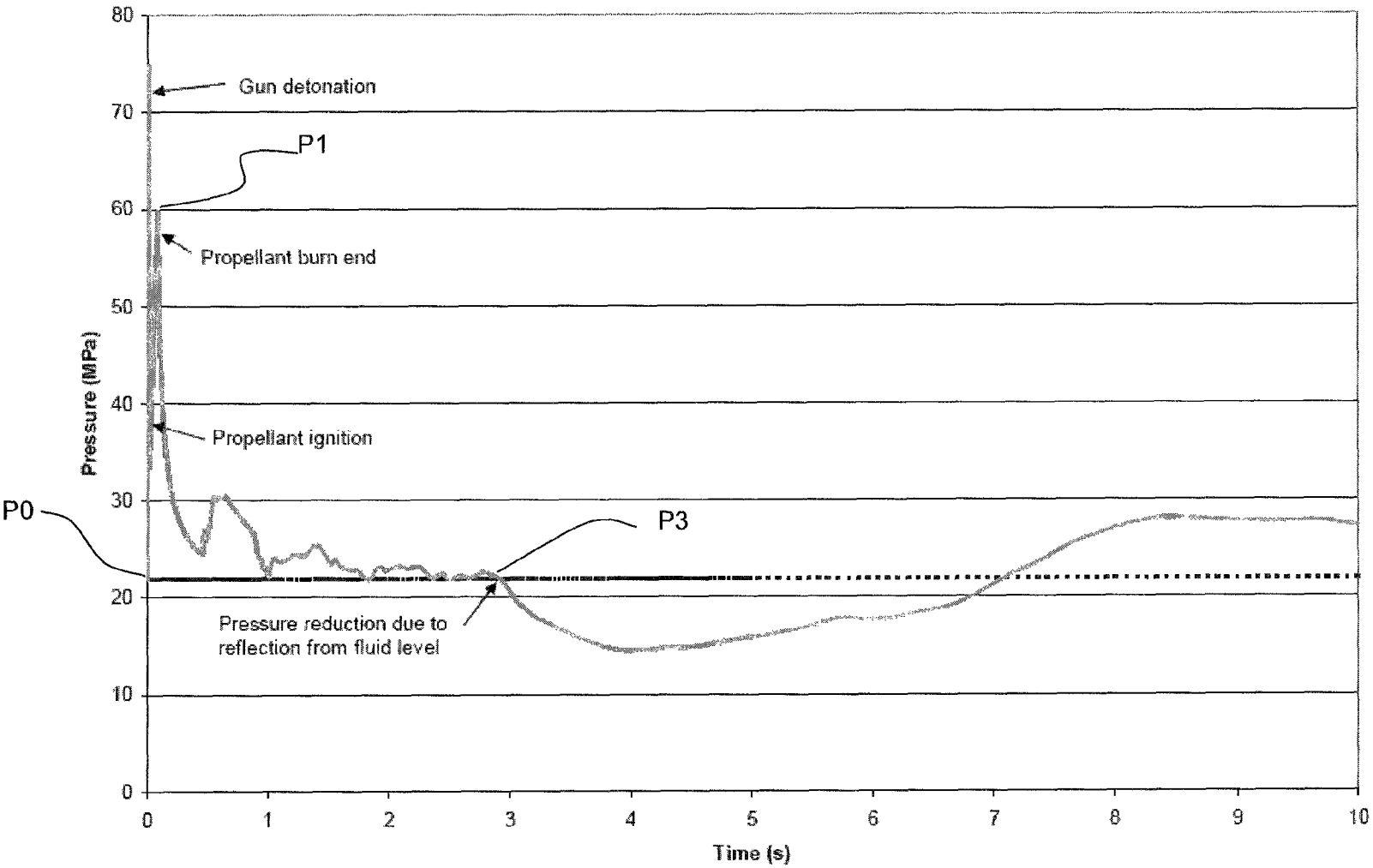
Fig. 13 Prior Art
FIG. 13 is a graph illustrating a modeled pressure profile resulting from a prior art detonation of a propellant-type perforating or stimulation gun according to Example 4.

With reference to the prior art of FIG. 13, applicant modeled a pressure profile for a stimulation gun without the introduction of any dynamic underbalance. Note that the pressure profile demonstrates a short-lived and sharp detonation pressure spike and a subsequent initial pressure event from the burning of the propellant. Eventually the pressure diminished from the initial pressure event shown here as taking about 1.8-2 s to approach the initial hydrostatic pressure P0 existing prior to perforation. Applicant further notes an inherent and strong underbalance which occurred as late as 3 seconds. This is believed to have been due to a strong pressure wave which reverberates up and down the wellbore and is characteristic of the propellant-type of perforating gun. This underbalance event, as hypothesized in Example 1, would appear to correspond to a reflected interface pressure wave reflecting off an interface between the annular fluid and some other medium, likely a high-impedance medium such as an uphole surface of the annular fluid.

Example 5

With reference to a plurality of pressure profiles of FIG. 14, and in the context of a propellant-type perforating gun, or Stimgun®, applicant reviewed the dynamic underbalance for a variety of differing time delays. Applicant noted that opening of the surge canister before the end of the propellant burn resulted in a lessening of the initial elevated pressure P1 during the initial pressure event (0.04 s) and the degree of dynamic underbalance ultimately achieved was reduced (0.04 d and 0.05 s). The underbalance (relative to the initial hydrostatic pressure) achieved prior to the completion of the propellant burn was about 5 MPa (720 psi) however, if allowed to substantially complete a propellant burn after 0.05 s, the magnitude of the resulting dynamic underbalance increased to about 15 MPa (2,175 psi). Ever longer time delays provided less variation in the magnitude of the dynamic underbalance achieved. Each time delay actuation applied as the pressure diminished from the initial elevated pressure resulted in a steepening or increased rate of change of the pressure which can be a factor in cleaning of perforation tunnels. Further the model determined that premature opening of the surge canister could result in shorter fractures length, if fracturing was even initiated at all.

Example 6

Figure 15:
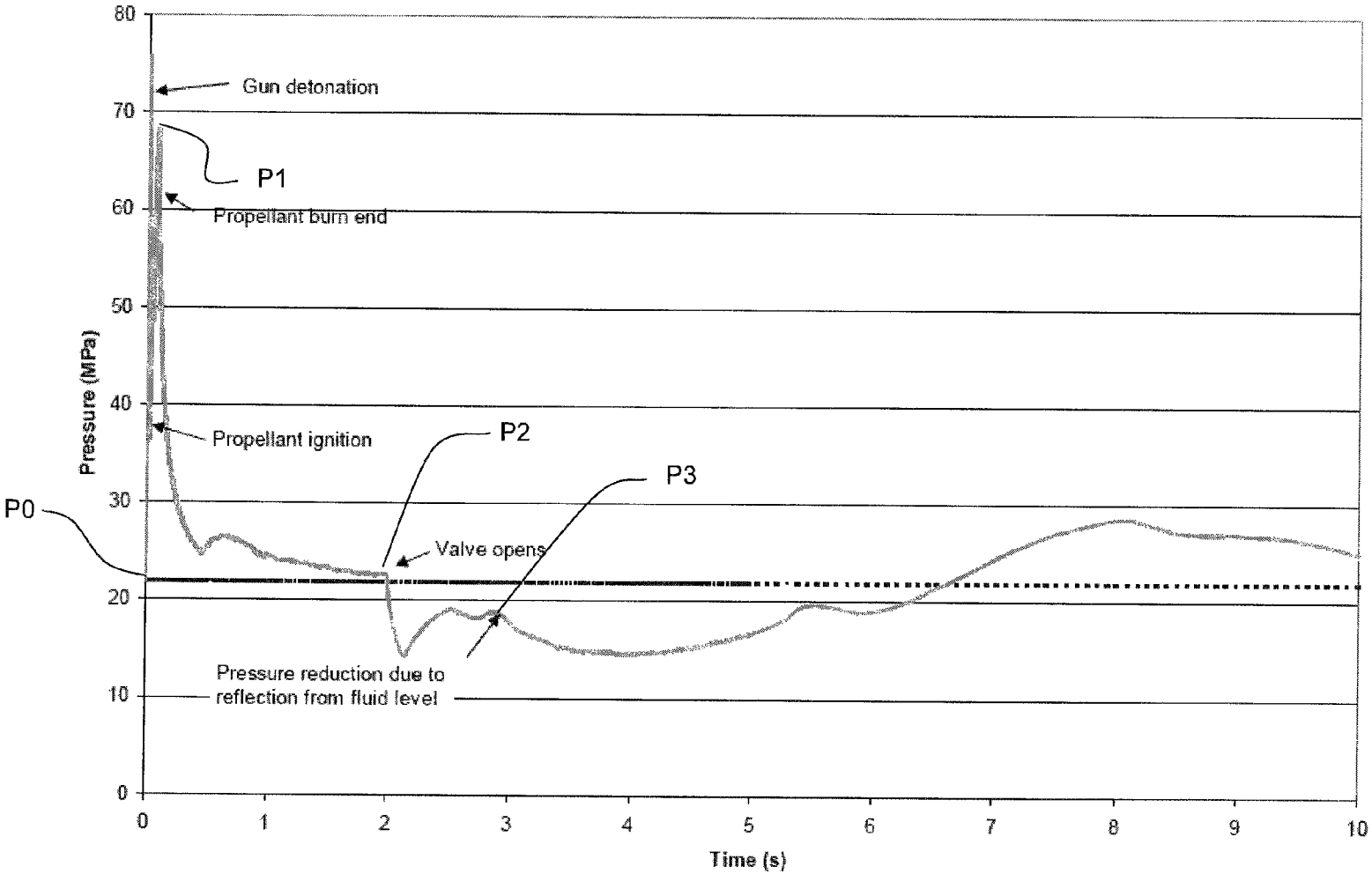
FIG. 15 is a graph illustrating a modeled pressure profile of the detonation of a stimulation gun followed by the opening of a surge canister after a 2 second time delay according to Example 6.
Figure 16:
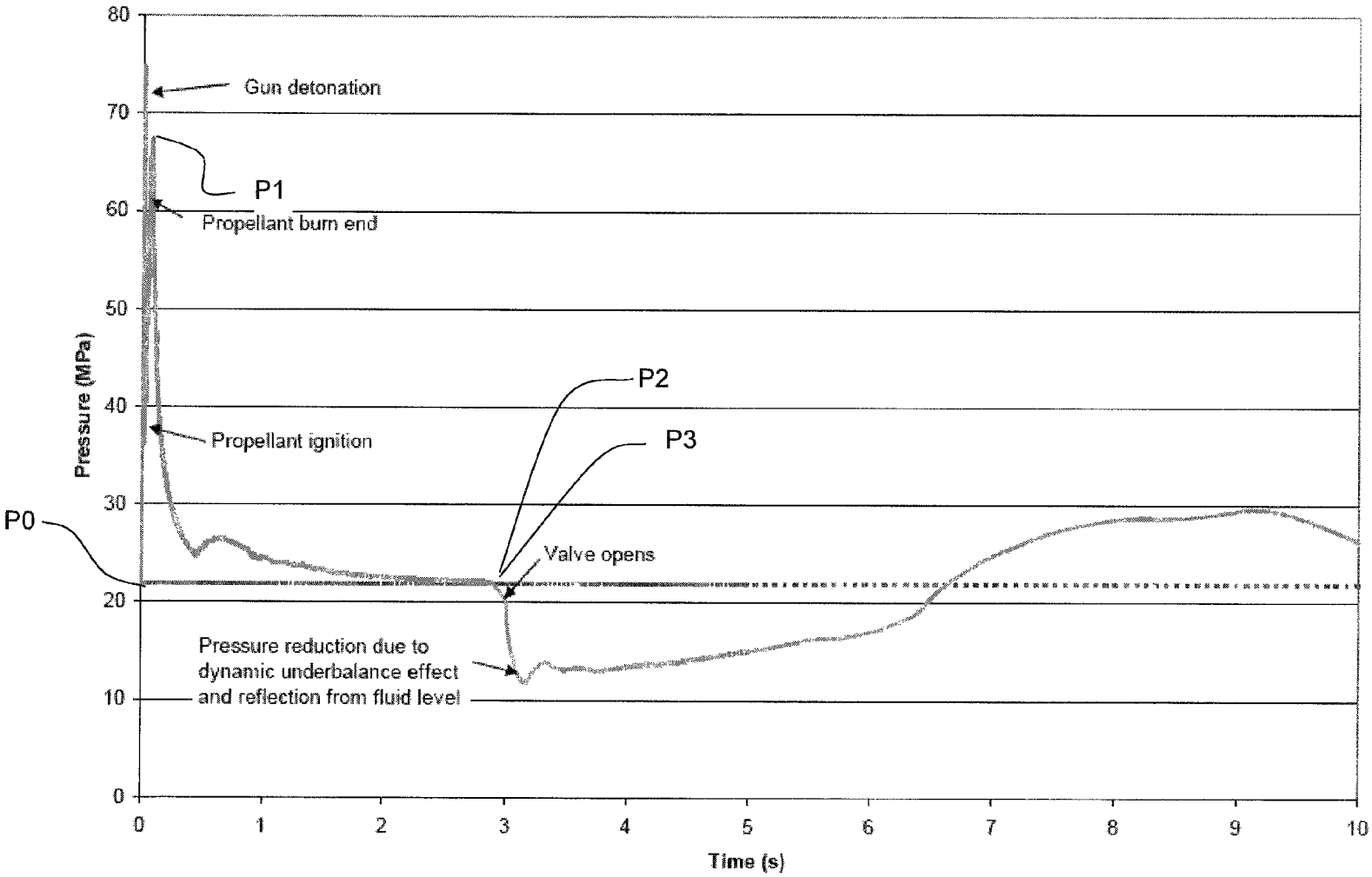
FIG. 16 is a graph illustrating a modeled pressure profile of the detonation of a stimulation gun followed by the opening of a surge canister after a 3 second time delay according to Example 7.
Figure 17:
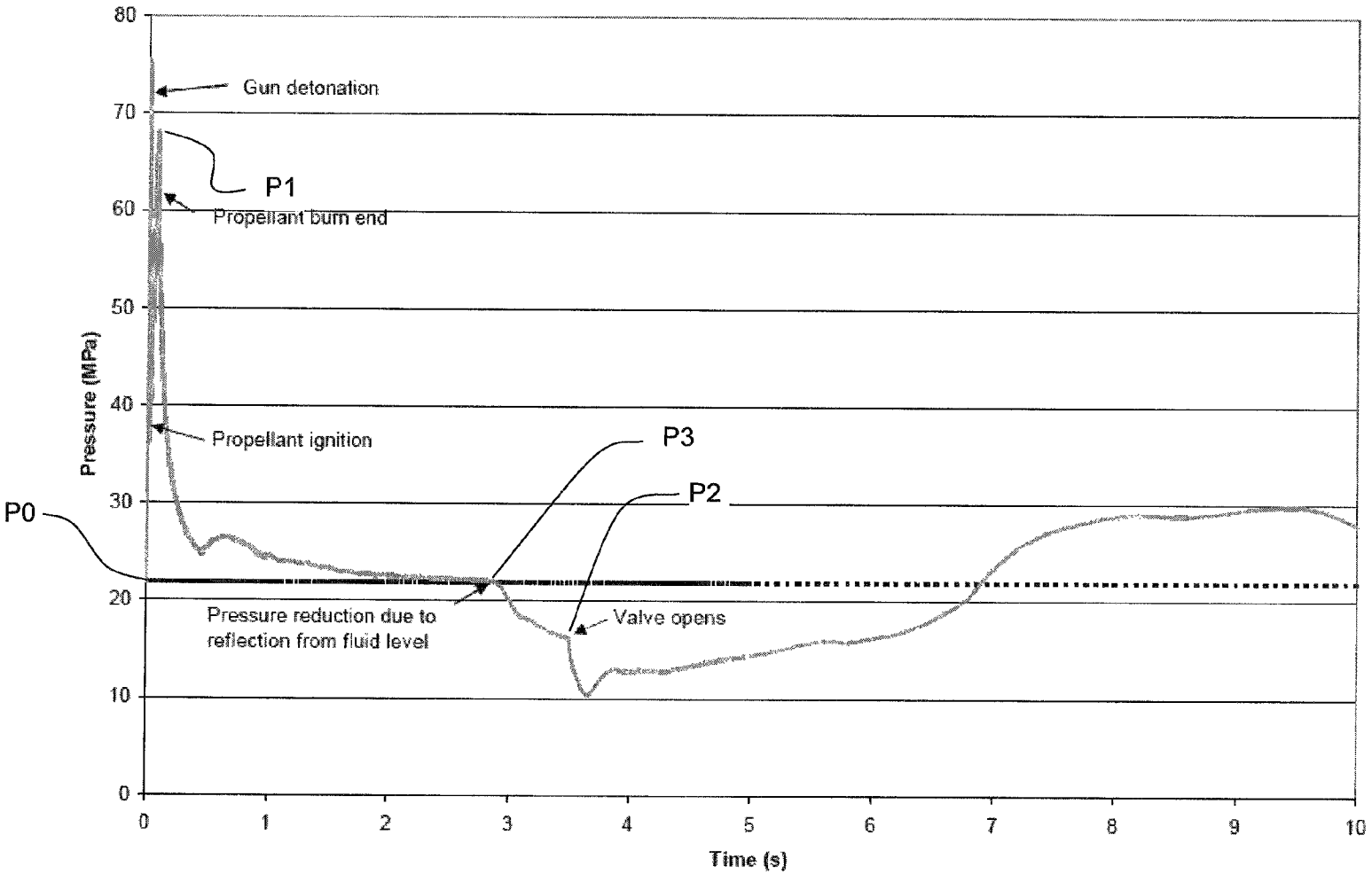
FIG. 17 is a graph illustrating a modeled pressure profile of the detonation of a stimulation gun followed by the opening of a surge canister after a 3.5 second time delay according to Example 8.
Figure 18A:
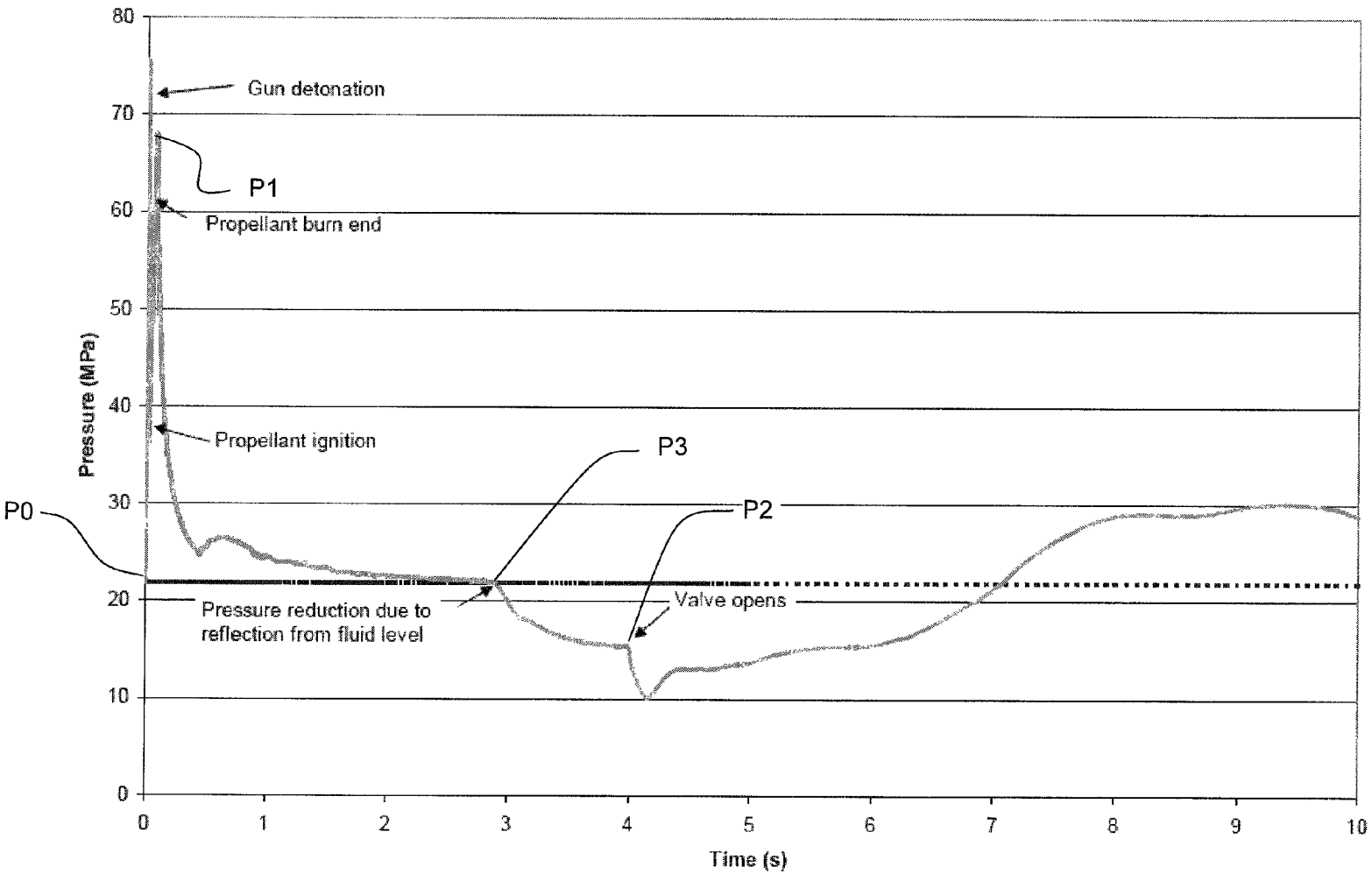
FIG. 18A is a graph illustrating a modeled pressure profile of the detonation of a stimulation gun followed by the opening of a surge canister after a 4 second time delay according to Example 9.
Figure 18B:
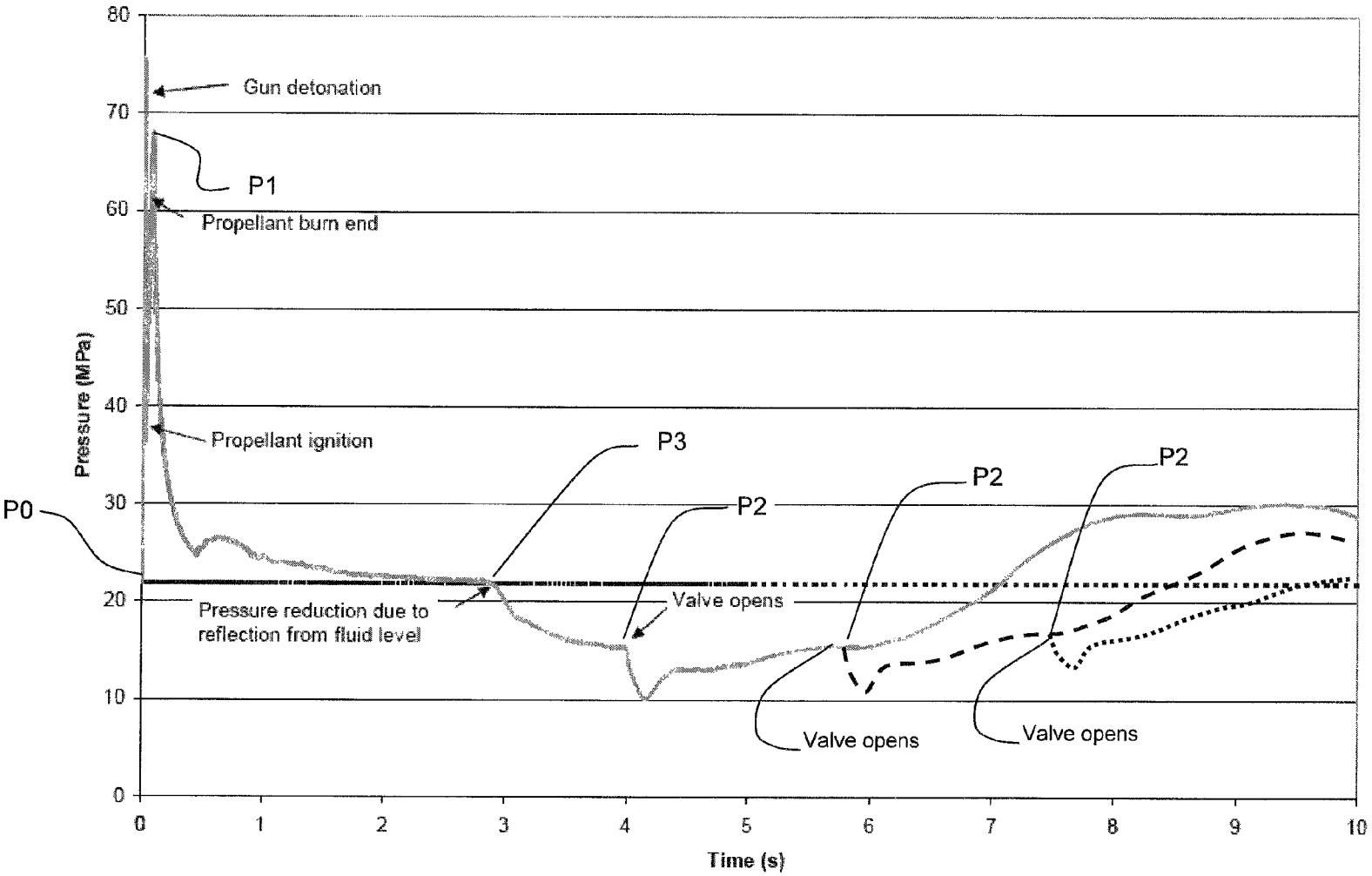
FIG. 18B is a graph illustrating hypothetical and sequential pressure profiles of the detonation of a stimulation gun followed by the opening of three surge canisters in sequence after a 4, 5.8 and 7.5 second time delays according to Example 10.

With reference to FIG. 15, applicant implemented an embodiment of the invention of dynamic underbalance combined with a stimulation gun. FIG. 16 illustrates a pressure profile when the stimulation gun was used in conjunction with a canister opening after a delay of two seconds after the detonation and about 1.8 s after the burn was substantially complete. The time delay was pre-determined to be after a substantial completion of burn of the propellant. The two second delayed opening of the canister was also noted to be prior to the arrival of an interface reflection pressure wave. The profile clearly demonstrates that the opening of the canister is sufficient to create a dynamic underbalance condition at approximately 2 seconds, despite the inherent and persistent overbalance pressure characteristics of a stimulation gun.

At approximately 3 seconds, while the pressure profile was still in a dynamic underbalanced condition, a sustaining underbalance was achieved when the interface reflection pressure wave arrived at the zone of interest.

Applicant noted that with the opening of the canister prior to the arrival of the interface reflection pressure wave resulted in a sustained period of underbalance condition of approximately 4.5 seconds between 2 s and 6.5 s.

Example 7

With reference to FIG. 16, again modeling a stimulation gun, applicant demonstrated the pressure profile when the surge canister is opened coincidentally with the arrival of an interface reflection pressure wave at about 3 s. Compared to the previous case of Example 6, the period of underbalance condition is somewhat shorter, at approximately 3.5 seconds, but the magnitude of the amplitude of the dynamic underbalance was more significant.

Example 8

FIG. 17, again modeling a stimulation gun, demonstrates the effect of opening the surge canister at about 3.5 seconds after the detonation of the stimulation gun. This actuation occurred after the interface reflection pressure wave arrived and the dynamic pressure profile was already depressed. Introducing the dynamic underbalance when the inherent underbalance was already in effect resulted in an even greater magnitude of the amplitude of the underbalance condition and the period of dynamic underbalance condition was sustained to approximately 4 seconds.

Opening the surge canister after the arrival of the interface reflection pressure wave, as opposed to coincidental or prior to, clearly had greater effect on the sustainability of the dynamic underbalance condition, having both a greater amplitude and a longer period of effect.

Example 9

FIG. 18A, again modeling a stimulation gun, demonstrates the effect of opening the canister at about 4 seconds after the detonation of the stimulation gun. This opening occurred well after the interface reflection pressure wave arrived and where the dynamic pressure profile had stabilized to a lower pressure than the previous example, perhaps at the lowest pressure or an inflection point. The magnitude of the dynamic underbalance was the greatest yet and the period of underbalance was sustained even longer at over 4 seconds.

Example 10

FIG. 18B, again modeling a stimulation gun and hypothesizing the effect of opening a sequence of canisters, a first canister was opened at about 4 seconds after the detonation of the stimulation gun. A second canister was opened at about 5.8 seconds with a hypothetical pressure response overlaid in dashed lines. A third canister was opened at about 7.5 seconds with a hypothetical pressure response overlaid in dotted lines. It is hypothesized that while the subsequent magnitude of each successive dynamic underbalance may not be as great as the first instance, the period of underbalance could be sustained for longer periods. Subsequent surge canister could be opened about coincidental or upon approaching hydrostatic equilibrium of a previous underbalance condition.

Flow Reducer Examples

In another embodiment of the invention applicant demonstrated that application of a pressure wave attenuator to isolate the zone of interest after the initial pressure event further increases the amplitude of the underbalance condition, be it inherent or dynamic, and more dramatically sustains the duration of the underbalance condition.

Example 11

Figure 19:
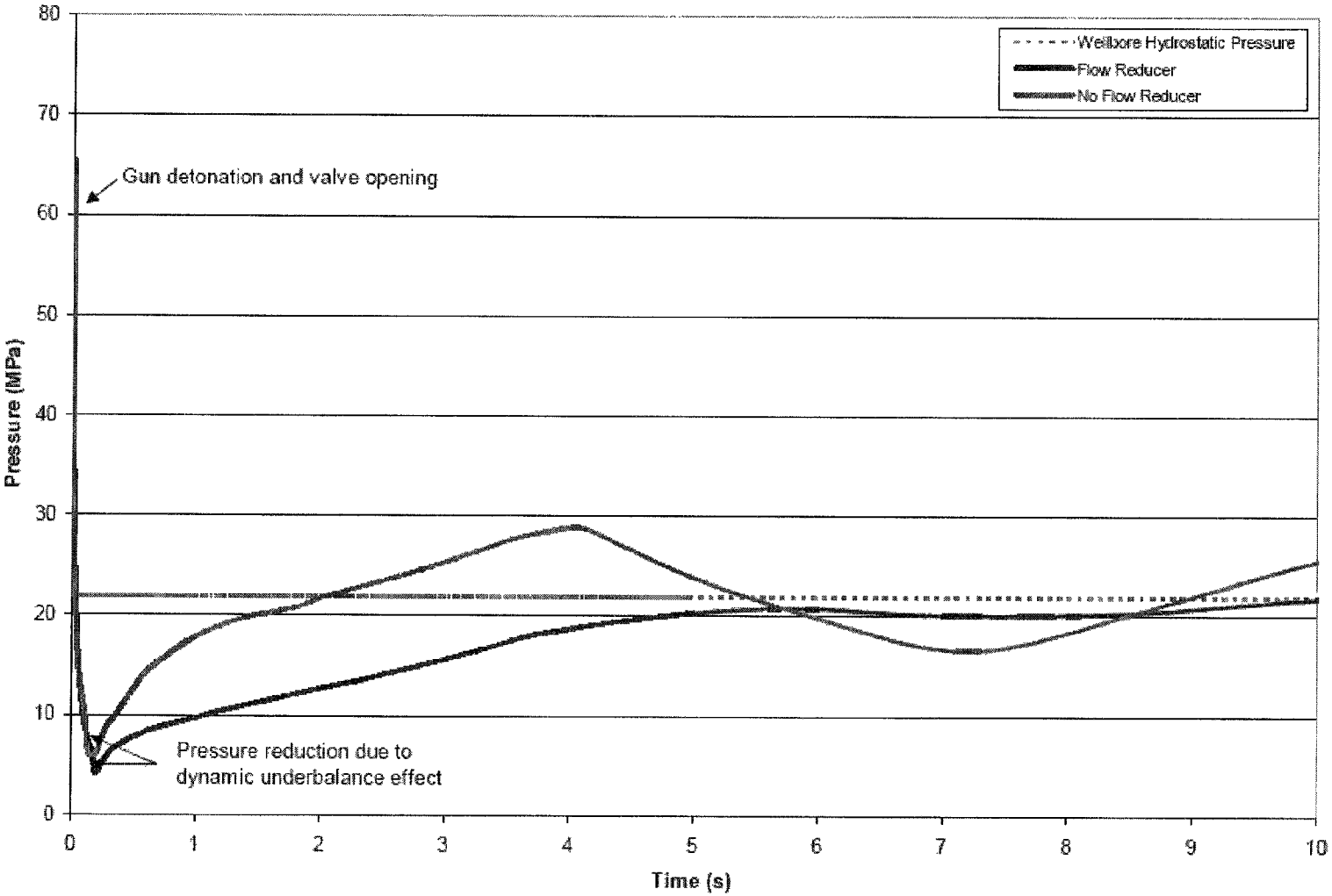
FIG. 19 is a graph illustrating a comparison of modeled pressure profiles according to Example 10 and of the detonation of a non-propellant type perforating gun of FIG. 11 compared to a the detonation of the perforating gun followed by the actuation of an uphole pressure wave attenuator or flow reducer according to one embodiment of the invention according to Example 11.

As shown in FIG. 19 for a non-propellant perforating gun, the prior art response is the top curve identical to that of FIG. 11. The second curve is a modeled response using a pressure wave attenuation device actuated after underbalance was achieved. Note that the dynamic underbalance is sustained, even without the introduction of a time delayed surge canister.

Example 12

Figure 20:
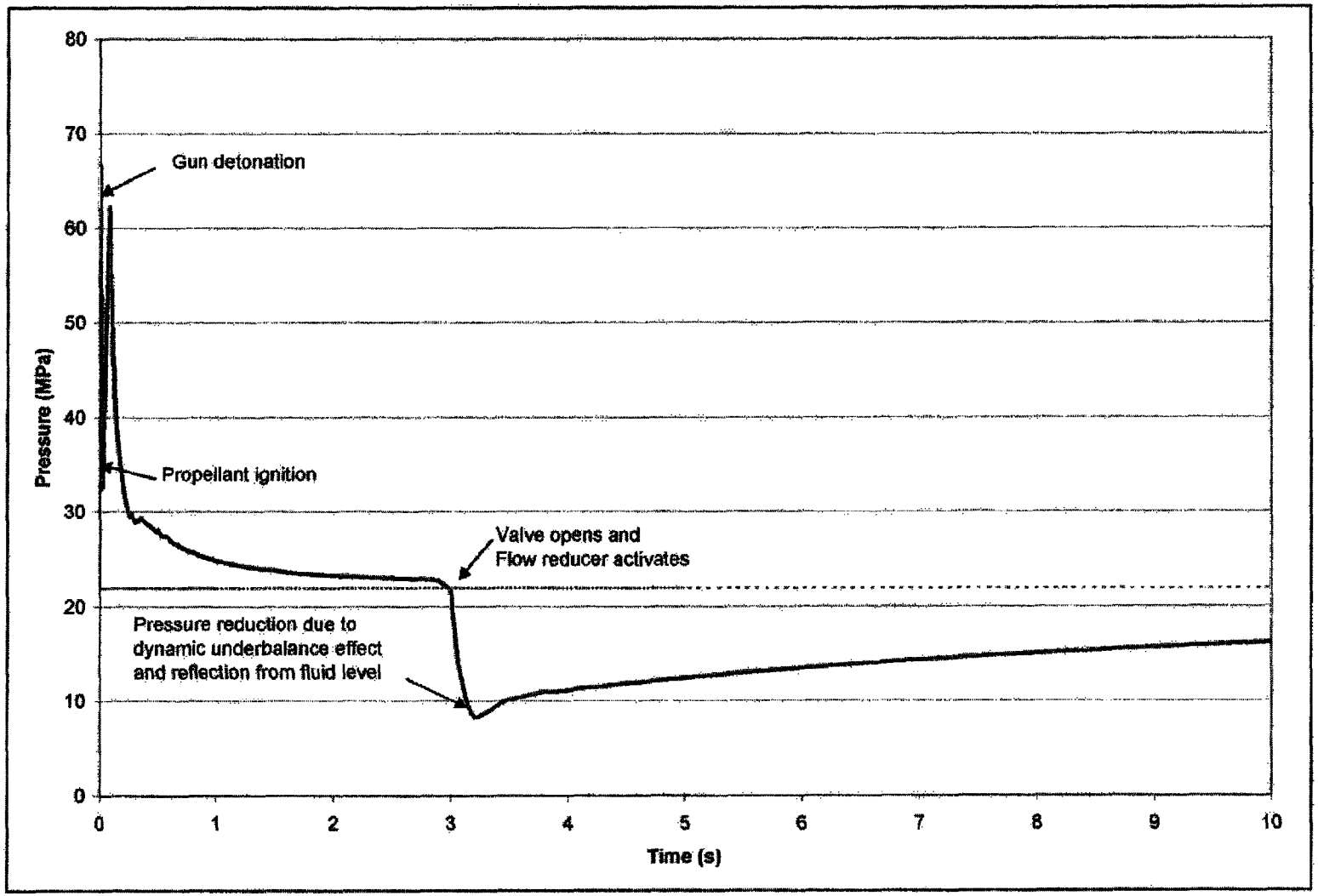
FIG. 20 is a graph illustrating a modeled pressure profile of the detonation of a stimulation gun followed by the opening of a surge canister coincident with a return pressure wave and incorporating actuation of a pressure wave attenuator according to Example 12.

As shown in FIG. 20 for a propellant-type stimulation gun, a surge canister was actuated to open coincident with the reflected pressure wave. As soon as the pressure wave depressed the pressure, the pressure wave attenuation device was actuated. Note the extremely long period of dynamic underbalance.

Various options are possible within the scope of the present invention. In some embodiments, perforating charges, such as those known for fracturing proppant canisters, are configured upon perforation to actuate and open the surge canisters and open the fluid for flow into the volume of the units. In other embodiments, an electrically actuated solenoid may be used to actuate the surge canisters and open the fluid from the annulus for flow into the surge canisters.

In another embodiment of the present invention, the trigger device 20 is not actuated by hydrostatic pressure from the detonation of the perforating gun 6, but is actuated electrically from the surface in a manner similar to that for actuating some perforating guns. In this embodiment, the timing mechanism of the pressure actuated embodiment can be surface based, simply requiring an electrical trigger, such as a solenoid.

The Embodiments of the Invention in which an exclusive property or privilege is claimed are defined as follows:

1. A method for creating a period of dynamic underbalance at a zone of interest in a wellbore comprising:

positioning a perforation assembly in the wellbore at the zone of interest for creating an annulus between the assembly and the wellbore, the annulus containing fluid and having an initial hydrostatic pressure, the assembly having at least a propellant-type perforation gun and one or more surge canisters, the initial hydrostatic pressure encouraging maximal burn of propellant of the propellant-type perforation gun;

actuating the propellant-type perforating gun for igniting the propellant, creating an initial pressure event and forming perforations at the zone of interest and wherein dynamic pressure in the annulus at the zone of interest reaches a first initial elevated pressure;

delaying until the dynamic pressure diminishes from the first initial elevated pressure;

wherein the initial pressure event creates an interface reflection pressure wave traveling along the wellbore and wherein the delaying further comprises delaying until about the time the interface reflection pressure wave reaches the zone of interest: and then opening at least one of the one or more surge canisters so as to receive a surge of the fluid therein for creating the period of dynamic underbalance.

2. The method of claim 1 wherein the initial hydrostatic pressure is at an overbalanced condition.

3. The method of claim 1, wherein the initial hydrostatic pressure is at a balanced condition.

4. The method of claim 1 wherein the delaying further comprises delaying until the initial pressure event is substantially complete.

5. The method of claim 4 wherein the initial pressure event is substantially complete when the dynamic pressure approaches a second threshold pressure lower than the first initial elevated pressure.

6. The method of claim 1 wherein the delaying is a predetermined time delay.

7. The method of claim 6 further comprising calculating the predetermined time delay wherein the opening at least one of the one or more surge canisters occurs when the dynamic pressure approaches a second threshold pressure lower than the first elevated pressure event.

8. The method of claim 7 wherein the second threshold pressure is at or near the initial hydrostatic pressure.

9. The method of claim 1 wherein the delaying is a predetermined time delay further comprising calculating the predetermined time delay for the interface reflection pressure wave to reach the zone of interest.

10. The method of claim 1 wherein the interface pressure wave acts to depress the dynamic pressure and wherein the delaying further comprises delaying until after the dynamic pressure is depressed by the interface reflection pressure wave.

11. The method of claim 1 further comprising:

measuring the dynamic pressure; and wherein the delaying further comprises delaying until the measured dynamic pressure is lower than the first initial elevated pressure.

12. The method of claim 11 wherein the delaying further comprises delaying until the measured dynamic pressure is about the initial hydrostatic pressure.

13. The method of claim 1 wherein after opening the at least one of the one or more surge canisters the method further comprises opening at least a subsequent surge canister for sustaining the period of dynamic underbalance.

14. The method of claim 1 wherein the delaying further comprises delaying until the burning of the propellant is substantially complete.

15. The method of claim 1 wherein the period of dynamic underbalance is further maximized comprising actuating a pressure wave attenuator for isolating the zone of interest from hydrostatic pressure thereabove when the interface reflection pressure wave reaches the zone of interest.

16. The method of claim 15, wherein actuating the pressure wave attenuator is by a pressure differential found in the annulus when the interface reflection pressure wave reaches the zone of interest.

17. A method for creating a period of dynamic underbalance at a zone of interest in a wellbore comprising:

positioning a perforation assembly in the wellbore at the zone of interest for creating an annulus between the assembly and the wellbore, the annulus containing fluid and having an initial hydrostatic pressure, the assembly having at least a propellant-type perforation gun and one or more surge canisters, the initial hydrostatic pressure encouraging maximal burn of propellant of the propellant-type perforation gun;

actuating the propellant-type perforating gun for igniting the propellant, creating an initial pressure event and forming perforations at the zone of interest and wherein dynamic pressure in the annulus at the zone of interest reaches a first initial elevated pressure;

delaying until the dynamic pressure diminishes from the first initial elevated pressure;

wherein the initial pressure event creates an interface reflection pressure wave traveling along the wellbore and wherein the delaying further comprises delaying until about the time the interface reflection pressure wave reaches the zone of interest; and then opening at least one of the one or more surge canisters so as to receive a surge of the fluid therein for creating the period of dynamic underbalance, wherein the period of dynamic underbalance is further maximized comprising actuating a pressure wave attenuator for isolating the zone of interest from hydrostatic pressure thereabove when the interface reflection pressure wave reaches the zone of interest.

18. The method of claim 17, wherein actuating the pressure wave attenuator is by a pressure differential found in the annulus when the interface reflection pressure wave reaches the zone of interest.

* * * * *